US005698357A

United States Patent [19]

Inoue et al.

[11] Patent Number: 5,698,357

[45] Date of Patent: Dec. 16, 1997

[54] TONER AND DEVELOPER FOR DEVELOPING ELECTROSTATIC LATENT IMAGE, AND IMAGE FORMING PROCESS USING THE SAME

[75] Inventors: Satoshi Inoue; Chiaki Suzuki; Kaori Ohishi; Hiroshi Nakazawa; Yoshifumi Iida, all of Minami Ashigara, Japan

[73] Assignee: Fuji Xerox Co., Ltd., Tokyo, Japan

[21] Appl. No.: 700,100

[22] Filed: Aug. 20, 1996

[30] Foreign Application Priority Data

Aug. 22, 1995 [JP] Japan ..... 7-234628
Dec. 12, 1995 [JP] Japan ..... 7-322654

[51] Int. Cl.[6] ..... G03G 9/10

[52] U.S. Cl. ..... 430/110; 430/126

[58] Field of Search ..... 430/106, 109, 430/137, 110, 126

[56] References Cited

U.S. PATENT DOCUMENTS

| | | | |
|---|---|---|---|
| 5,482,806 | 1/1996 | Suzuki et al. | 430/109 |
| 5,510,222 | 4/1996 | Inaba et al. | 430/109 |

FOREIGN PATENT DOCUMENTS

| | | |
|---|---|---|
| 46-5782 | 12/1971 | Japan . |
| 48-47345 | 7/1973 | Japan . |
| 48-47346 | 7/1973 | Japan . |
| 58-184951 | 10/1983 | Japan . |
| 58-216252 | 12/1983 | Japan . |
| 60-123862 | 7/1985 | Japan . |
| 60-136755 | 7/1985 | Japan . |
| 60-238847 | 11/1985 | Japan . |
| 61-120157 | 6/1986 | Japan . |
| 64-73354 | 3/1989 | Japan . |
| 1-237561 | 9/1989 | Japan . |
| 2-110474 | 4/1990 | Japan . |
| 2-187771 | 7/1990 | Japan . |
| 3-208060 | 9/1991 | Japan . |
| 4-70849 | 3/1992 | Japan . |
| 4-175769 | 6/1992 | Japan . |
| 5-72797 | 3/1993 | Japan . |
| 5-181320 | 7/1993 | Japan . |
| 5-188633 | 7/1993 | Japan . |
| 5-204183 | 8/1993 | Japan . |
| 5-224466 | 9/1993 | Japan . |

OTHER PUBLICATIONS

Kagaku Kogaku Ronbunshu, vol. 8, No. 3, (1992), pp. 303–307.

*Primary Examiner*—John Goodrow
*Attorney, Agent, or Firm*—Oliff & Berridge

[57] ABSTRACT

A toner for developing an electrostatic latent image, which comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent.

14 Claims, 1 Drawing Sheet

TONER AND DEVELOPER FOR DEVELOPING ELECTROSTATIC LATENT IMAGE, AND IMAGE FORMING PROCESS USING THE SAME

FIELD OF THE INVENTION

This invention relates to a toner for developing an electrostatic latent image, a developer containing the same, and an image forming process, each for use in electrophotography or electrostatic recording.

BACKGROUND OF THE INVENTION

Electrophotographic image formation comprises developing an electrostatic latent image formed on a photoreceptor with a toner comprising a colorant dispersed in a binder resin, transferring the toner image to receiving paper, and fixing the transferred toner image by means of, for example, a hot roll. The photoreceptor after the transferring step is cleaned to make it ready for next latent image formation. Developers used in such electrophotography, called dry developers, are divided into a one-component developer that is a toner itself and a two-component developer comprising a toner and a carrier. In order for these developers to have process suitability in making copies, they are required to be excellent in fluidity, resistance against caking, fixing properties, chargeability, and cleanability. In order to improve these properties, especially fluidity and caking resistance, inorganic fine powder is often added to a toner as an external additive. However, inorganic fine powder gives considerable influences on charging properties. More specifically, silica fine powder, which is commonly used for the above described purposes, exhibits strong negative chargeability and excessively increases the chargeability of a negatively chargeable toner particularly under a low temperature and low humidity condition. Furthermore, silica powder takes in moisture under a high temperature and high humidity condition to cause a reduction in chargeability. As a result, silica powder produces a great difference in chargeability depending on the environmental conditions, which tends to cause insufficient reproduction of image density and background stains. Dispersibility of inorganic fine powder also have large influences on the characteristics of the toner. If the disperse state of the inorganic powder added is non-uniform, the powder tends to fail to improve fluidity and caking resistance as expected, or sufficient cleaning of the photoreceptor tends not to be achieved. Insufficient cleaning leads to toner filming on the photoreceptor, which causes image defects such as black dots.

To solve these problems, surface treatment of inorganic powder to be added has been proposed. For example, JP-A-46-5782, JP-A-48-47345 and JP-A-48-47346 (the term "JP-A" as used herein means an "unexamined published Japanese patent application") disclose treatment for rendering the surface of silica fine particles hydrophobic. However, sufficient effects on eliminating a difference in chargeability between the environmental conditions cannot be obtained merely by using the hydrophobic silica powder.

It is known that negative chargeability of toner particles can be moderated by addition of silica fine particles surface-treated with an amino-modified silicone oil (see JP-A-64-73354) or silica fine particles surface-treated with an aminosilane and/or an amino-modified silicone oil (see JP-A-1-237561). Although an excessive increase in chargeability of a negative chargeable toner can be suppressed by the treatment with these amino compounds, the environmental dependence of silica fine powder per se cannot be sufficiently improved by the treatment. That is, the excessive negative chargeability of silica fine particles, as is observed after long-term use under a low temperature and low humidity condition, is slightly suppressed, but the same charge neutralization takes place also in long-term use under a high temperature and high humidity condition. Therefore, the environmental dependence still remains.

Addition of such an inorganic oxide as hydrophobic titanium oxide has also been proposed as disclosed in JP-A-58-216252, JP-A-60-123862 and JP-A-60-238847. Since titanium oxide has low chargeability, it is easy to control the level of chargeability and environmental dependence by using a treating agent. A sulfuric acid process for obtaining titanium oxide crystals from ilmenite and a chlorine process for obtaining titanium oxide fine particles are generally known. Because these processes involve heating and calcination of wet-processed titanium oxide, the product obtained unavoidably contains chemical bonds as a result of dehydrating condensation. It is not easy to re-disperse such agglomerated particles by a conventional technique. That is, because titanium oxide taken out as fine powder contains secondary and tertiary agglomerates, it is considerably inferior to silica powder in terms of effect of improving toner fluidity. To meet the increasing demand for high quality in image (inclusive of color image) formation, attempts have been made to achieve high image quality through size reduction of toner particles. However, size reduction of toner particles results in an increase in adhesion among particles, making the toner fluidity worse.

In order to achieve improvement of fluidity without increasing environmental dependence, a combined use of hydrophobic titanium oxide and hydrophobic silica has been proposed in JP-A-60-136755. In this case, the respective disadvantages of hydrophobic silica and hydrophobic titanium oxide are suppressed temporarily, but the toner tends to be influenced by either additive depending on the disperse state. It is difficult to stably control the dispersion state of additives on the surface of toner particles and particularly to maintain the dispersion, so that either hydrophobic silica or hydrophobic titanium oxide tends to predominate over the other in manifestation of its own characteristics with passage of time or due to the stress of agitation. That is, it has been difficult to control their several disadvantages over a long period of time in a stable manner.

Addition of hydrophobic amorphous titanium oxide to a toner has been proposed as disclosed in JP-A-5-204183 and JP-A-5-72797. Amorphous titanium oxide is obtained by hydrolysis of a metal alkoxide or a metal halide by a CVD method (see *Kaqaku Koqaku Ronbunshu*, Vol. 18, No. 3, pp.303–307 (1992)).

Titanium oxide obtained by hydrolysis can provide both improved charging characteristics and improved fluidity but tends to remain on the photoreceptor after transfer because of its high content of adsorbed water. In other words, the amorphous titanium oxide is not transferred to image-receiving sheet and remains on the photoreceptor due to its strong adhesion to the photoreceptor. The thus remained amorphous titanium oxide on the photoreceptor causes a white spot on a toner image or gives scratches to the photoreceptor on cleaning because of its hardness.

In wet process production of titanium oxide, it has been proposed to treat the surface of titanium oxide by hydrolysis of a coupling agent in an aqueous medium as disclosed in JP-A-5-188633. According to this technique, titanium oxide particles can be collected in a less agglomerated state for use as an external additive to a toner.

When titanium oxide is treated with a silane coupling agent by the above-described technique, the resulting surface-treated titanium oxide gives improved charging characteristics and improved fluidity to a negatively chargeable toner in the initial stage. However, the treating agent (silane coupling agent) added to the toner surface is apt to peel off by crashes against a carrier in agitation or slides on a blade and a sleeve. As a result, the charging characteristics of the toner in use largely vary. That is, the peeling-off of the treating agent seriously reduces the life of the developer. While the mechanism has not been clarified, the peeling-off seems ascribable to the weak basicity of titanium oxide. Although a surface reaction takes place between titanium oxide and a silane coupling agent, the bonds formed are much weaker than those formed by the reaction of silica, etc. with a treating agent for making silica hydrophobic. It is generally known that a titan coupling agent, on the other hand, forms strong bonds with titanium oxide. In order to carry out the above technique, it is required that a treating agent be soluble or dispersible in water. Most of currently available titan coupling agents have a long chain length and are therefore insoluble in water. Therefore, it is hard to be used for the treatment. Although only titan coupling agents containing an amino group are soluble in water, such a type of titan coupling agents imparts positive chargeability and is not suited to negatively chargeable toners.

On the other hand, when a resin-treated carrier is used in a two-component developer, it is easy to control charging properties and it is relatively easy to reduce environmental dependence and to improve stability against the lapse of time. With reference to a development system, while cascade development was used formerly, magnetic brush development using a magnetic roll as a developer transporting carrier has now taken the place. In a one-component development system, a specific resin or a charge control agent is incorporated into a developing roll, a toner feed roll, a charging blade, etc. for improving image quality and performance stability.

Magnetic brush development using a two-component developer involves such problems as reduction in image density due to deterioration of chargeability of the developer, development of considerable background stains, image roughening and waste of the carrier due to adhesion of the carrier to an image, and development of unevenness in image density. The chargeability of a developer is apt to deteriorate due to adhesion of a toner component onto the coat of the carrier or peeling-off of the carrier coat.

In order to prevent deterioration of chargeability, it has been proposed to increase the hardness of the coating resin to thereby prevent the coat from peeling off, and/or to reduce the surface energy of the coating resin to thereby prevent a toner component from adhering to the carrier coat. For example, JP-A-2-187771, JP-A-3-208060, JP-A-4-70849 and JP-A-5-181320 disclose a carrier coated with a polyolefin resin, and JP-A-58-184951 discloses a carrier coated with a silicone resin. Although carriers coated with a polyolefin resin or a silicone resin are effective in preventing a toner component from adhering to the surface of the carrier, these carriers are disadvantageous in that these resins have poor adhesion to the core particle and are liable to peel off by the stress of agitation or by crashes against toner particles in a developing machine. Further, mere coating with a polyolefin resin or a silicone resin is insufficient for imparting negative chargeability to a toner.

To overcome the above problem, JP-A-5-224466 proposes a carrier coated with a silicone-modified acrylic resin. This resin exhibits improved adhesion to the core and improved negative charge imparting properties as compared with a silicone resin, but the problems of adhesion of a toner component onto the coat or of wear of the coat still remain unsolved. It is quite certain, while the mechanism is unclear, that an inorganic oxide added externally to the toner for improving the toner fluidity gives some adverse influence. In the case of commonly used silica fine powder, for example, it has intense negative chargeability and tends to electrostatically render a carrier positive-chargeable, resulting in accelerated contamination of the surface of the carrier. Further, as previously mentioned, silica powder excessively increases the chargeability of a negatively chargeable toner under a low temperature and low humidity condition, while taking moisture therein under a high temperature and high humidity condition to cause a reduction in chargeability. As a result, the chargeability largely varies depending on the environmental conditions.

In the case of titanium oxide powder, it does not increase the environmental dependence so much as silica powder but the absolute amount of the imparted negative chargeability to a toner is reduced. Having weak negative chargeability, it does not electrostatically render a carrier positive-chargeable. However, titanium oxide serves as an abrasive to accelerate the wear of the carrier surface.

Use of a fluorine resin-coated carrier has been proposed so that the low surface energy of fluorine may be taken advantage of in preventing a toner and an external additive from adhering the carrier coat and thereby inhibiting the reduction of developer life. For example, a combination of a perfluoroacrylate-coated carrier and a hydrophobic silica-containing toner (JP-A-61-120157), a combination of a fluorine resin-coated carrier and silica powder treated with polysiloxane ammonium salt (JP-A-2-110474), and a combination of fluorinated alkyl acrylate polymer-coated carrier and titanium oxide or alumina (JP-A-4-175769) have been proposed for that purpose. However, the combinations of a fluorine resin-coated carrier and treated silica, while effective in the initial stage of electric charging, the charge distribution becomes broader and the retention of performance on addition of a supplementary toner deteriorates with the increase of agitation time. The combination of a fluorine resin-coated carrier and titanium oxide, while providing satisfactory charging characteristics, still involves the disadvantage that a treating agent easily peels off, resulting in a remarkable reduction in developer life. The combination with alumina is unsuitable for a negatively chargeable developer because of the strong positive chargeability of alumina.

SUMMARY OF THE INVENTION

An object of the invention is to provide a negatively chargeable toner for developing an electrostatic latent image which exhibits stabilized negative chargeability while retaining its triboelectric chargeability and exhibits reduced environmental dependency, as well as excellent fluidity and caking resistance.

Another object of the invention is to provide a negatively chargeable toner which does not scratch the photoreceptor, etc., and provides high quality images free from defects.

A further object of the invention is to provide a developer and an image forming process using the above-described toner.

A still further object of the invention is to provide a developer and an image forming process in which (1) variation of image quality due to changes in charging properties of a charging member, which changes are caused by adhesion of a toner component to a charging member or by peeling-off of a coating layer from the charging member, is reduced, (2) deterioration in density reproducibility due to changes in charging properties of a toner, which changes are caused by environmental changes in temperature or humidity, can be suppressed, (3) background stains which develop on feeding an additional toner can be reduced, and the life of the developer and the charging member are extended, and (4) adhesion of a carrier to an image is prevented to not only minimize waste of the carrier but to assure high image quality in a stable manner to thereby provide an image with high reproducibility in both black solid areas and fine lines.

As a result of extensive study, the inventors of the present invention have found that the above objects are accomplished by externally adding to toner particles titanium oxide fine particles which are obtained by coating titanium oxide fine particles with 0.1 to 2.0% by weight, in terms of $Al_2O_3$, of aluminum or $Al_2O_3$ and further treating the aluminum- or $Al_2O_3$-coated particles.

A toner of the present invention, which is used for developing an electrostatic latent image, comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent.

In a preferred embodiment, the surface treatment is carried out in a solution by using a treating agent selected from an anionic surface active agent, an amphoteric surface active agent, a silane coupling agent and a silicone oil.

A developer of the present invention, which is used for developing an electrostatic latent image, comprises the above-described toner and a resin-coated carrier, In a preferred embodiment, the coating-resin mainly comprises a silicone-modified acrylic resin, a fluoroalkyl acrylate resin or a fluoroalkyl methacrylate resin. It is also preferable that the resin-coated carrier has a volume resistivity of $10^6$ to $10^{12}$ Ω.cm at $10^{3.8}$ V.

An image forming process of the present invention comprises the steps of:

forming an electrostatic latent image on an electrostatic latent image holder;

developing the electrostatic latent image on the electrostatic latent image holder with a developer held on a developer carrying member disposed so as to face the electrostatic latent image holder, to thereby form a toner image; and transferring the thus formed toner image to an image-receiving sheet, wherein the developer in the developing step comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent.

In a preferred embodiment, the process further comprises charging the developer by a charging member, wherein the charging member comprises a silicone-modified acrylic resin, a fluoroalkyl acrylate resin or a fluoroalkyl methacrylate resin.

DETAILED DESCRIPTION OF THE INVENTION

Figure 1:
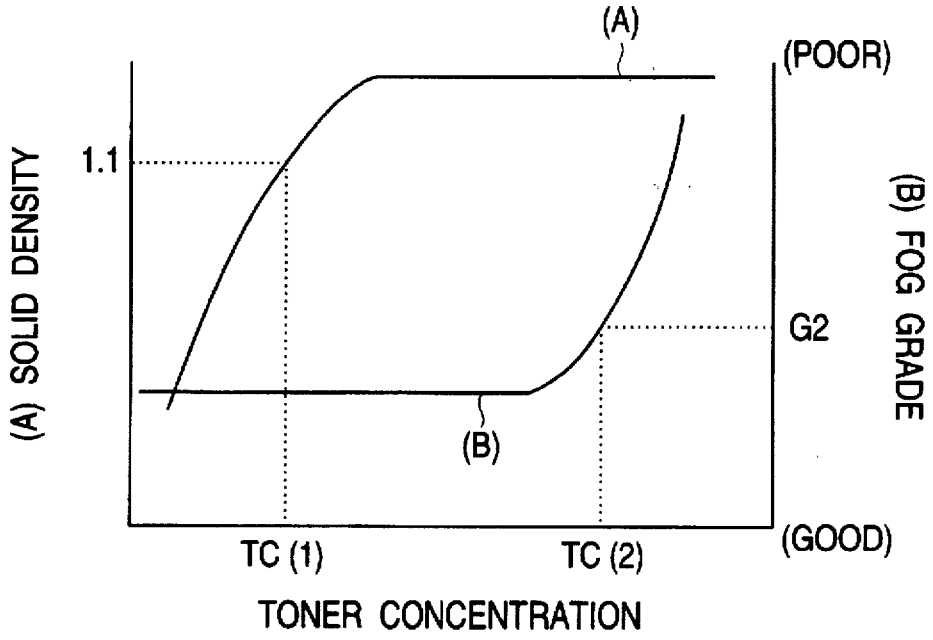
FIG. 1 is a graph showing the relationship of toner concentration vs. solid density and fog grade.

Toner particles for use in the invention are conventional and mainly comprise a binder resin and a colorant. Examples of the binder resin for toner particles include homopolymers or copolymers prepared from styrene, styrene derivatives (e.g., chlorostyrene), monoolefins (e.g., ethylene, propylene, butylene and isoprene), vinyl esters (e.g., vinyl acetate, vinyl propionate, vinyl benzoate and vinyl butyrate), α-methylene aliphatic monocarboxylic acid esters (e.g., methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate), vinyl ethers (e.g., vinyl methyl ether, vinyl ethyl ether and vinyl butyl ether) and vinyl ketones (e.g., vinyl methyl ketone, vinyl hexyl ketone and vinyl isopropenyl ketone). Of these, typical examples include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. Additionally, polyesters, polyurethane, epoxy resins, silicone resins, polyamide, modified rosin and paraffin wax are also useful.

Examples of the colorant for toner particles include magnetic powder such as magnetite and ferrite, carbon black, Aniline Blue, Calco Oil Blue, Chrome yellow, Ultramarine Blue, Du Pont Oil Red, Quinoline Yellow, Methylene Blue chloride, Phthalocyanine Blue, Malachite Green oxalate, lamp black, Rose Bengal, C.I. Pigment Red 48:1, C.I. Pigment Red 12:2, C.I. Pigment Red 57:1, C.I. Pigment Yellow 97, C.I. Pigment Yellow 12, C.I. Pigment Blue 15:1 and C.I. Pigment Blue 15:3. The content of the colorant in the toner particle is generally from 1 to 70% by weight.

If desired, the toner of the invention may comprises a charge control agent. Known charge control agents can be used in the present invention. Suitable charge control agents include azo series metal complex compounds, metallic compound of salicylic acid and polar group-containing resin. Further, a wax such as low-molecular weight polypropylene and low-molecular weight polyethylene may also be added as an offset preventive. The toner particles may be either magnetic toner particles containing a magnetic material or nonmagnetic toner particles containing no magnetic material. The toner particles can be prepared by a conventional method comprising kneading, grinding and classification or by a polymerization method. The shape of the toner particles may be amorphous or spherical. Preferred average particle size of the toner particles is preferably from 3 to 15 μm.

The treated titanium oxide fine particles added as an external additive to the toner particles are particles obtained by coating titanium oxide fine particles with 0.1 to 2.0% by weight of aluminum or $Al_2O_3$, in terms of $Al_2O_3$ conversion based on the weight of the coated-titanium oxide particles, and subjecting the coated particles to surface treatment with a treating agent. The treating agent for use in the surface treatment preferably comprises at least one kind of treating agent selected from an anionic surface active agent, an amphoteric surface active agent, a silane coupling agent and a silicone oil.

Provision of an aluminum or $Al_2O_3$ coating film on titanium oxide particles prevents a treating agent from peeling off. The mechanism, though unclear, might be accounted for as follows. Because $Al_2O_3$ has a relatively high isoelectric point, the coating film has positive surface charges in the vicinity of neutrality. Thus, a treating agent supplied to the surface of the coating film having such a condition is adsorbed thereon as oriented to render the surface of the titanium oxide fine particles lipophilic. It is considered that the bonding is enhanced upon application of heat to inhibit peeling-off of the surface treating agent.

The coating weight of the aluminum or $Al_2O_3$ coating film should be in the range of from 0.1 to 2.0% by weight in terms of $Al_2O_3$. If it is less than 0.1% by weight, the effects of the coating are lessened. If it exceeds 2.0% by weight, the positive chargeability of aluminum is manifested to reduce the chargeability of a negatively chargeable toner.

Thus, a treating agent on titanium oxide fine particles does not peel off even subjected stress over a long period of time, and stable negative chargeability can be assured.

The aluminum or $Al_2O_3$ coating film can be formed easily by a method comprising adding aluminum chloride, aluminum nitrate, aluminum sulfate, etc. to an aqueous solution or a solvent, dipping titanium oxide fine particles in the solution, and drying the particles or by a method comprising adding hydrated alumina, hydrated alumina-silica, hydrated alumina-titania, hydrated alumina-titania-silica or hydrated alumina-titania-silica-zinc oxide to an aqueous solution or a solvent, dipping titanium oxide fine particles in the solution, and drying the particles. The surface treatment of titanium oxide particles with the treating agent is carried out by wet grinding the thus aluminum- or $Al_2O_3$-coated particles, classifying the ground particles, treating the particles in an aqueous solution or a solvent with a treating agent, followed by filtration, washing, drying and grinding. The coating film formation and the surface treatment can be carried out simultaneously. The aqueous solution and the solvent for use in the above described coating and surface treatment are not particularly limited. Temperature control in drying the surface treated particles is important. Drying of the surface treated particles is preferably conducted at 80° to 200° C. At drying temperatures below 80° C., the resulting bonding force of the treating agent is insufficient. At drying temperatures above 200° C., re-bonding of particles occurs to form agglomerates. The treated titanium oxide fine particles for use in the invention generally have an average primary particle size of from 1 to 40 nm, preferably not greater than 20 nm.

Examples of the treating agent for use in the surface treatment preferably includes an anionic surface active agent, an amphoteric surface active agent, a silane coupling agent, a silicone oil, and mixtures thereof. These treating agents can be used in combination with a fatty acid or a fatty acid ester.

Any type of anionic surface active agents, such as a carboxylic acid type, a sulfuric ester type, a sulfonic acid type and a phosphoric ester type, can be used. Examples of useful anionic surface active agent include fatty acid salts, rhodinic acid salts, naphthenic acid salts, ether carboxylic acid salts, alkenylsuccinic acid salts, N-acylsarcosinic acid salts, N-acylglutamic acid salts, primary alkylsulfates, secondary alkylsulfates, polyoxyethylene alkylsulfates, polyoxyethylene alkylphenylsulfates, monoacylglycerosulfates, acylaminosuluric ester salts, sulfated oils, sulfated fatty acid alkyl esters, α-olefinsulfonic acid salts, secondary alkanesulfonic acid salts, α-sulfofatty acid salts, acylisethionic acid salts, N-acyl-N-methyltaurine, dialkylsulfosuccinic acid salts, alkylbenzenesulfonic acid salts, alkylnaphthalenesulfonic acid salts, alkyl diphenyl ether disulfonic acid salts, petroleum sulfonic acid salts, lignin sulfonic acid salts, alkyl phosphates, polyoxyethylene alkyl phosphates, polyoxyethylene alkylphenyl phosphates, perfluoroalkylcarboxylic acid salts, perfluoroalkylsulfonic acid salts and perfluoroalkyl phosphoric esters.

The term "amphoteric surface active agent" used herein means a substance which has charge dissociation within its molecular structure but has no charge as the whole molecular structure. Examples of the amphoteric surface active agent include N-alkylnitrilotriacetic acids, N-alkyldimethylbetains, α-trimethylammoniofatty acids, N-alkyl-β-aminopropionic acid salts, N-alkyl-β-iminobipropionic acid salts, N-alkyloxymethyl-N,N-diethylbetains, N-alkyl-N,N-diaminoethylglycine hydrochloric acid salts, 2-alkylimidazoline derivatives, N-alkylsulfobetains, N-alkylhydroxysulfobetains, salts of N-alkyltaurine, lecithin and perfluoroalkylbetains.

Any type of silane coupling agents, such as a chlorosilane type, an alkoxysilane type, a silazane type, and specific silylating agents, can be used. Examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane.

The silicone oils include straight silicone oils and modified silicone oils. Examples thereof include dimethylsilicone oil, methylhydrogensilicone oil, methylphenylsilicone oil, cyclic dimethylsilicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil and fluorine-modified silicone oil.

Examples of the preferred treating agent for use in the present invention include silane coupling agents containing a hydrocarbon group having from 1 to 10 carbon atoms, dimethylsilicone oil, methylhydrogensilicone oil, methylphenylsilicone oil, fluorine-containing anionic surface active agents and fluorine-containing amphoteric surface active agents.

Examples of the fatty acids which can be used in combination with the above described treating agents include saturated straight-chain or branched fatty acids such as lauric acid, stearic acid, myristic acid and palmitic acid, unsaturated fatty acids such as monoene fatty acids and polyene fatty acids, hydroxyfatty acids, dibasic carboxylic acids, keto-acids, epoxycarboxylic acids, furancarboxylic acids and cyclic fatty acids.

Examples of the fatty acid esters which can be used in combination with the above described treating agents include monohydric alcohol fatty acid esters such as methyl laurate, methyl myristate, methyl palmitate, methyl stearate, coconut oil fatty acid methyl ester, isopropyl myristate, butyl stearate, octadecyl stearate and oleyl oleate; and polyhydric alcohol fatty acid esters such as fatty acid glycerides, glycol fatty acid esters and sorbitan fatty acid esters. In addition, fatty acid amides, N-substituted fatty acid amides, fatty acid amines, fatty acid ketones, fatty acid imides and the like can also be used as long as they are soluble in a solvent used.

Of the above-described treating agents, a combination of a silane coupling agent and a fatty acid or a fatty acid ester is preferred; because peeling-off of the treating agent does not occur even subjected stress over a long period of time, and further because the surface layer of a carrier and a surface layer of a photoreceptor are prevented from wearing owing to the lubricating action of the fatty acid or fatty acid ester without giving adverse influence on fluidity of the toner, to thereby provide charging performance and developing performance in a stable manner for an extended period of time.

The amount of the treating agent to be adhered onto the titanium oxide particles is generally 5 to 50% by weight, preferably 5 to 20% by weight, based on the aluminum- or $Al_2O_3$-coated titanium oxide particles, while it varies depending on the primary particle size of titanium oxide. The amount of the fatty acid or fatty acid ester, if used in combination, is generally 1 to 20% by weight, preferably 3 to 10% by weight, based on the aluminum- or $Al_2O_3$-coated titanium oxide particles. Since the purpose of the surface treatment by the treating agent is to impart negative chargeability to a toner, to reduce environmental dependence of toner performance, to improve toner fluidity, and to reduce adverse influences on a photoreceptor, the amount of the treating agent should be decided appropriately so as to achieve the purpose while taking compatibility with the coated amount of the underlying aluminum or $Al_2O_3$ into consideration.

The titanium oxide fine particles for use in the present invention are generally prepared by a common wet process. Examples of the wet process, in which titanium oxide is produced through chemical reaction in a solvent, are roughly divided into a sulfate process and a chloride process.

The outline of the sulfate process can be represented by the following reaction formulas. The following reactions proceed in the liquid phase, giving an insoluble hydrous titanium oxide. This hydrous titanium oxide is calcined to obtain fine particles of a crystalline titanium oxide.

$$FeTiO_3+2H_2SO_4 \rightarrow FeSO_4+TiOSO_4+2H_2O$$

$$TiOSO_4+2H_2O \rightarrow TiO(OH)_2+H_2SO_4$$

In the chloride process, $TiCl_4$ is first prepared as in a dry process, dissolved in water, and hydrolyzed while pouring a strong base to obtain $TiO(OH)_2$. The outline of the chloride process can be represented by the following reaction formulas.

$$TiCl_4+H_2O \rightarrow TiOCl_2+2HCl$$

$$TiOCl_2+2H_2O \rightarrow TiO(OH)_2+2HCl$$

$$TiO(OH)2 \rightarrow TiO_2+H_2O$$

Generally, the above described process is followed by repeating the steps of washing with water and filtration, and thus obtained product is calcined to obtain fine particles of a crystalline titanium oxide.

The surface treated titanium oxide fine particles are mixed with toner particles by means of, for example, a twin-cylinder mixer or a Henschel mixer. In blending, various additives can be added if desired. For example, other fluidizing agents, cleaning assistants (e.g., polystyrene fine particles, polymethyl methacrylate fine particles and polyvinylidene fluoride fine particles) or transfer assistants may be added. The addition amount of the surface treated titanium oxide fine particles are preferably from 0.1 to 5% by weight, preferably from 0.2 to 3% by weight, based on the total weight of the toner.

The surface treated titanium oxide fine particles may be adhered to the surface of toner particles through mere mechanical adhesion or be adhered to the surface loosely. The surface treated titanium oxide fine particles may be present on the surface of a toner particle partly in an agglomerated state but is preferably present in a single layer state.

The toner having adhered thereon the surface treated titanium oxide fine particles can be used as a magnetic one-component developer containing magnetic powder, or can be combined with a carrier to provide a magnetic two-component developer. The toner can also be used as a nonmagnetic one-component developer containing no magnetic powder but containing a colorant, or can be combined with a carrier to provide a nonmagnetic two-component developer. For use in two-component developers, the surface treated titanium oxide fine particles may be mixed as an external additive with toner particles beforehand, or they may be added when toner particles and a carrier are mixed to treat the surface of the toner particles with the external additive simultaneously with the mixing with a carrier.

The carrier for use in the two-component developer preferably includes iron powder, glass beads, ferrite powder, nickel powder, magnetite powder, the above-mentioned particles coated with a resin (resin-coated carriers), and resin-dispersed type carriers prepared by kneading a magnetic material together with a resin, a charge control agent, etc., grinding the blend and classifying the grinds. In the case of a resin-coated carrier, the core for use in the present invention is preferably ferrite powder or magnetite powder, but may be made of any material as far as it is almost spherical and the state of the surface (i.e., the surface roughness) thereof is controllable. The carrier generally has an average particle size of about 20 to 120 μm.

Examples of the resin that can be used for coating the surface of a carrier core include silicone resins, fluorine-containing resins, styrene-acrylate resins, epoxy resins, alkylene resins and the like. In particular, resins mainly comprising a silicone-modified acrylic resin, a fluoroalkyl acrylate resin or a fluoroalkyl methacrylate resin are preferred. The term "acrylate" and the term "methacrylate" will be sometimes referred as to (meth)acrylate inclusively.

The silicone-modified acrylic resin mainly comprises a copolymer of an organopolysiloxane represented by formula (I) shown below and other polymerizable monomer(s).

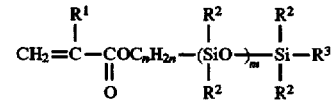

(I)

wherein $R^1$ represents a hydrogen atom or a methyl group; $R^2$ represents an alkyl group having from 1 to 10 carbon atoms or a phenyl group; $R^3$ represents an alkyl group having from 1 to 10 carbon atoms, a phenyl group or $CH_{2=C(R^1)}COOC_nH_{2n}$; n represents a number of from 1 to 3; and m is a number of 2 or greater.

In formula (I), m is preferably 4 or greater for manifestation of the nature of silicone, and is preferably not greater than 80 for avoiding surface stickiness of the resin-coating.

Copolymers comprising the organopolysiloxane of formula (I) and a hydrolyzable silyl-containing (meth)acrylic compound represented by formula (II) shown below are preferred for their increased adhesion to a core.

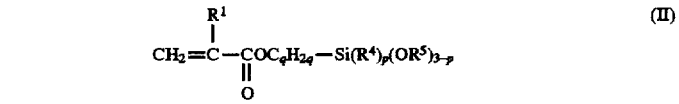

(II)

wherein $R^4$ and $R^5$ each represents an alkyl group having from 1 to 10 carbon atoms; q represents a number of from 1 to 3; and p represents a number of from 0 to 2.

Examples of the above described other polymerizable monomers that can be copolymerized with the compound of formula (I) (or the compound of formula (I) and the compound of formula (II)) include monocarboxylic acids or esters thereof such as acrylic acid, methacrylic acid, methyl (meth)acrylate, cyclohexyl methacrylate, 2-ethylhexyl (meth)acrylate, 2-hydroxyethyl(meth)acrylate, n-butyl acrylate and 2-hydroxypropyl(meth)acrylate; styrene or derivatives thereof such as styrene, α-methylstyrene and chlorostyrene; vinyl ethers such as vinyl methyl ether, vinyl ethyl ether, vinyl isobutyl ether and vinyl cyclohexyl ether; vinyl esters such as vinyl chloride, vinyl bromide, vinyl acetate, vinyl propionate, vinyl butyrate and vinyl benzoate; (meth)acrylic acid derivatives such as acrylonitrile and methacrylonitrile; vinylnaphthalenes; vinyl ketones such as vinyl methyl ketone and vinyl hexyl ketone; and N-vinyl compounds such as N-vinylpyrrole, N-vinylcarbazole, N-vinylindole and N-vinylpyrrolidone. These monomers can be used alone or in combination of two or more kinds thereof.

The compound of formula (II) and the above-described other polymerizable monomers are preferably copolymerized in a total proportion of 5 to 100 parts by weight, particularly 8 to 70 parts by weight, per 10 parts by weight of the organopolysiloxane of formula (I). If the proportion of these comonomers is less than 5 parts, the surface of the resin coating layer tends to be sticky. If it exceeds 100 parts, the characteristics of silicone are not manifested.

A curing catalyst can be used in combination with the silicone-modified acrylic resin for curing the resin coating. Suitable curing catalysts include dibutyltin diacetate, dibutyltin dioctate, dibutyltin dilaurate, tetraisopropyl titanate tetrabutyl titanate, γ-aminopropyltriethoxysilane, and N-(β-aminoethyl)aminopropyltriethoxysilane.

The fluoroalkyl(meth)acrylate resin include homopolymers of a fluoroalkyl(meth)acrylate monomer and copolymers of a fluoroalkyl(meth)acrylate and other copolymerizable monomer(s). Examples of fluoroalkyl moiety of the fluoroalkyl(meth)acrylates are 1,1-dihydroperfluoroethyl, 1,1-dihydroperfluoropropyl,
1,1-dihydroperfluorohexyl, 1,1-dihydroperfluorooctyl,
1,1-dihydroperfluorodecyl, 1,1-dihydroperfluorolauryl,
1,1,2,2-tetrahydroperfluorobutyl,
1,1,2,2-tetrahydroperfluorohexyl,
1,1,2,2-tetrahydroperfluorooctyl,
1,1,2,2-tetrahydroperfluorodecyl,
1,1,2,2-tetrahydroperfluorolauryl,
1,1,2,2-tetrahydroperfluorostearyl,
2,2,3,3-tetrahydroperfluoropropyl,
2,2,3,3,4,4-hexahydroperfluorobutyl,
1,1,1-trihydroperfluorohexyl, 1,1,1-trihydroperfluorooctyl,
1,1,1,3,3,3-hexafluoro-2-propyl,
3-perfluorononyl-2-acetylpropyl,
3-perfluorolauryl-2-acetylpropyl,
N-perfluorohexylsulfonyl-N-methylaminoethyl,
N-perfluorohexylsulfonyl-N-butylaminoethyl,
N-perfluorooctylsulfonyl-N-ethylaminoethyl,
N-perfluorooctylsulfonyl-N-butylaminoethyl,
N-perfluorodecylsulfonyl-N-methylaminoethyl,
N-perfluorodecylsulfonyl-N-ethylaminoethyl,
N-perfluorodecylsulfonyl-N-butylaminoethyl,
N-perfluorolaurylsulfonyl-N-methylaminoethyl and
N-perfluorolaurylsulfonyl-N-butylaminoethyl.

Examples of the above described other monomers copolymerizable with the fluoroalkyl(meth)acrylate monomers include styrene monomers such as styrene, alkylstyrenes (e.g., methylstyrene, dimethylstyrene, trimethylstyrene, ethylstyrene, diethylstyrene, trtethylstyrene, propylstyrene, butylstyrene, hexylstyrene, heptylstyrene and octylstyrene), halogenated styrenes (e.g., fluorostyrene, chlorostyrene, bromostyrene, dibromostyrene and iodostyrene), nitrostyrene, acetylstyrene and methoxystyrene; addition polymerizable unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid and angelic acid; addition polymerizable unsaturated aliphatic dicarboxylic acids such as maleic acid, fumaric acid, itaconic acid, citraconic acid, mesaconic acid, glutaconic acid and dihydromuconic acid; and esters of the above-enumerated addition polymerizable unsaturated aliphatic mono- or dicarboxylic acid and an alcohol, examples of the alcohol including alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol), partially alkoxylated alkyl alcohols (i.e., alkoxyalkyl alcohols, e.g., methoxyethyl alcohol, ethoxyethyl alcohol, ethoxyethoxyethyl alcohol, methoxypropyl alcohol and ethoxypropyl alcohol), aralkyl alcohols (e.g., benzyl alcohol, phenylethyl alcohol and phenylpropyl alcohol) and alkenyl alcohols (e.g., allyl alcohol and crotonyl alcohol). Of theses, alkyl(meth)acrylates, alkyl fumarates and alkyl maleates are preferred.

The fluoroalkyl(meth)acrylate copolymers preferably contain at least 5% by weight, particularly at least 20% by weight, of the fluoroalkyl(meth)acrylate unit.

By using a carrier coated with the perfluoroalkyl (meth) acrylate resin or with the silicone-modified acrylic resin, there is provided a developer in which a toner component is prevented from adhering to the carrier, and the carrier coating is prevented from separating from the core. The developer therefore exhibits excellent durability over a long period of time, and can provide an image with satisfactory reproducibility in both solid areas and fine lines and free from background stains which may develop on feeding an additional toner.

The resin-coated carrier can be prepared by dispersively mixing the core particles and the coating resin in a solvent such as toluene, and removing the solvent by heating. The resin-coated carrier can also be prepared by mixing the coating resin with the core particles at ordinary temperature followed by heating to a temperature above the fusion temperature of the resin, or prepared by adding the core particles to the coating resin heated to a temperature above the fusion temperature thereof. Examples of useful apparatus include a heating kneader, a heating Henschel mixer, a UM mixer and a planetary mixer.

The resulting coated particles can be used as a carrier as it is, or can further be coated, if desired, with other resins by hot-melt coating or solution coating to provide a resin-coated carrier having a laminate structure.

The resin-coating amount is preferably from 0.1 to 5% by weight based on the weight of the resin-coated carrier.

The suitable toner content in the two-component developer depends on the particle size of the toner and carrier, but generally from 2 to 15 parts by weight per 100 parts by weight of the carrier.

The above-described resin-coated carriers preferably have a volume resistivity of $10^6$ to $10^{12}$ Ω.cm. Where conventional treated silica or titanium oxide is used as an external additive, the additive adheres to the carrier considerably to change the volume resistivity of the coated carrier. If the volume resistivity of a carrier exceeds $10^{12}$ Ω.cm, charges caused by friction with a toner hardly leak, and the carrier will have increased adhesion to the photoreceptor, making it difficult to develop an electrostatic latent image. If the volume resistivity of a carrier becomes lower than $10^6$ Ω.cm, the developing efficiency increases, but low-potential areas of the photoreceptor, which is generated through migration of the carrier to the photoreceptor followed by exposure, will be re-charged, ultimately deteriorating the image quality.

The image forming process according to the present invention comprises the steps of forming an electrostatic latent image on an electrostatic latent image holder, developing the electrostatic latent image formed on the electrostatic latent image holder with a developer on a developer carrying member disposed to face the electrostatic latent Image holder, to thereby form a toner image, and transferring the thus formed toner image to an image-receiving sheet, wherein the above-described toner for developing an electrostatic latent image is used in the step of developing. An electrophotographic photoreceptor and a dielectric recording member can be used as the electrostatic latent image holder, on which an electrostatic latent image is formed in a conventional manner. The electrostatic latent image is visualized (developed) with a developer containing the toner that is held on a developer carrying member facing the latent image holder. The developer carrying member includes, for example, a magnetic roll fixed into a rotatable nonmagnetic sleeve, and is placed face to face with the latent image holder. The toner image thus formed on the latent image holder is then transferred to an image-receiving sheet in a conventional manner.

The developing sleeve for use in a one-component developing system is preferably coated with the same resin as that used for the above-described resin-coated carrier. In particular, the above described silicone-modified acrylic resins and fluoroalkyl(meth)acrylate resins are preferred. Examples of the charging member for use in a one-component development system using a magnetic one-component developer include a metallic sleeve made of stainless steel, aluminum, etc. and an elastic charging blade made of a silicone resin, a urethane resin, EPDM, etc. The charging member also is preferably coated with the same resin as that used for the above-described resin-coated carrier. The silicone-modified acrylic resin is particularly preferred for coating the charging member to be used for a magnetic one-component developer. In this case, the excellent characteristics of an acrylic resin, i.e., the ability to impart sufficient negative chargeability to a toner can be realized, and the siloxane chain functions to reduce contamination of the sleeve or the charging member with a toner component.

The present invention will be described in greater detail with reference to the following Examples, but the invention should not be construed as being limited thereto. Unless otherwise specified, all the parts and percents are given by weight.

Titanium oxide used in Examples was prepared by a wet precipitation method comprising dissolving ilmenite in sulfuric acid, removing the iron content, and hydrolyzing $TiOSO_4$ as described above. The key of the wet precipitation method resides in conditions in dispersing and washing for hydrolysis and nucleation. In particular, the pH (adjusted by neutralization with an acid) in dispersing and the slurry concentration are decisive for the primary particle diameter of the resulting titanium oxide and therefore require highly precise control.

The $Al_2O_3$ weight of the aluminum or $Al_2O_3$ coating film and the weight of the treating agent for surface treated titanium oxide fine particles (external additive) were determined as follows.

Measurement of coating weight in terms of $Al_23$:

1) Untreated titanium oxide fine particles and untreated $Al_2O_3$ fine particles were mixed to prepare standard samples respectively having an $Al_2O_3$ content of 0.05%, 0.1%, 0.5%, 1.0%, 2.0%, 3.0%, 5.0% or 10.0% by weight.

2) A predetermined amount of the respective standard samples was weighed out on a cell, and subjected to X-ray fluorometry (Riken System 3370) to prepare an analytical curve.

3) The same amount of a sample as in (2) was weighed out on a cell, and analyzed by X-ray fluorometry, and the weight of $Al_2O_3$ was determined from the analytical curve.

Measurement of weight of treating agent:

1) Untreated titanium oxide fine particles were dry treated with a treating agent (each of an anionic surface active agent, an amphoteric surface active agent, a silane coupling agent and a silicone oil) to prepare standard samples having 5%, 10%, 20%, 50% or 100% by weight of the treating agent, assuming that 100% of the treating agent added had adhered to the surface of the titanium oxide particles.

2) A predetermined amount of the respective standard samples was weighed out on a cell, and subjected to X-ray fluorometry (Riken System 3370) to prepare an analytical curve.

3) The same amount of a sample as in (2) was weighed out on a cell and analyzed by X-ray fluorometry, and the weight of the treating agent was determined from the analytical curve, paying attention to a characteristic element (e.g., Si or F).

Preparation of Additive A:

Titanium oxide fine particles obtained by the above-described technique were calcined, wet ground, and classified to remove coarse particles. To the resulting titanium oxide fine particles was added a diluted solution of hydrated alumina, and the dispersion was filtered and dried at 100° C. to obtain $Al_2O_3$-coated titanium oxide fine particles. The particles were again wet ground in a water solvent. After coarse particles were removed, the particles were treated with isobutyltrimethoxysilane, filtered, washed with water, dried at 100° C., and dry ground to obtain additive A.

The following additives A were prepared according to the above-described method. The term "$Al_2O_3$ coating weight" used below represents a coating weight of aluminum or $Al_2O_3$ converted into $Al_2O_3$.

| | |
|---|---|
| Additive A-(1): | $Al_2O_3$ coating weight = 0.1%; isobutyltrimethoxysilane = 10% |
| Additive A-(2): | $Al_2O_3$ coating weight = 0.8%; isobutyltrimethoxysilane = 10% |
| Additive A-(3): | $Al_2O_3$ coating weight = 2.0%; isobutyltrimethoxysilane = 10% |
| Additive A-(4): | $Al_2O_3$ coating weight = 2.5%; isobutyltrimethoxysilane = 10% |

Preparation of Additive B:

Titanium oxide fine particles obtained by the above-described technique were calcined, wet ground, and classified to remove coarse particles. To the resulting titanium oxide fine particles was added aluminum sulfate. Subsequently, ammonium perfluoroalkylsulfonate ($C_8F_{17}SO_3NH_4$) dissolved in an alcohol was added thereto, followed by filtration, washing with water, drying at 100° C., and dry grinding to obtain additive B.

The following additives B were prepared according to the above-described method.

| | |
|---|---|
| Additive B-(1): | $Al_2O_3$ coating weight = 1.0%; perfluoroalkylsulfonic acid = 20% |
| Additive B-(2): | $Al_2O_3$ coating weight = 0.2%; perfluoroalkylsulfonic acid = 5% |
| Additive B-(3): | $Al_2O_3$ coating weight = 2.0%; perfluoroalkylsulfonic acid = 20% |
| Additive B-(4): | $Al_2O_3$ coating weight = 2.0%; perfluoroalkylsulfonic acid = 50% |

Preparation of Additive C:

Additive C was prepared in the same manner as for additive B except for replacing ammonium perfluoroalkylsulfonate with methylhydrogensilicone oil.

| | |
|---|---|
| Additive C-(1): | $Al_2O_3$ coating weight = 1.0%; methylhydrogensilicone oil = 20% |

Preparation of Additive D:

Additive D was prepared in the same manner as for additive B except for replacing ammonium perfluoroalkylsulfonate with perfluoroalkylbetaine ($C_8F_{17}SO_2NH(CH_2)_3^+(CH_3)_2CH_2COO^-$).

| | |
|---|---|
| Additive D-(1): | $Al_2O_3$ coating weight = 1.0%; perfluoroalkylbetaine = 20% |

Preparation of Additive E:

Titanium oxide fine particles obtained by the above-described technique were calcined, wet ground, and classified to remove coarse particles. To the resulting titanium oxide fine particles was added a diluted solution of hydrated $Al_2O_3$, and the dispersion was filtered and dried at 100° C. to obtain $Al_2O_3$-coated titanium oxide fine particles. Methylhydrogensilicone oil was sprayed onto the $Al_2O_3$-coated particles in a dry process, and the coated particles were heat-treated at 150° C. and dry ground to obtain additive E.

| | |
|---|---|
| Additive E-(1): | $Al_2O_3$ coating weight = 1.0%; methylhydrogensilicone oil = 20% |

Preparation of Additive F:

Titanium oxide fine particles obtained by the above-described technique were calcined, wet ground, and classified to remove coarse particles. To the resulting titanium oxide fine particles was added a diluted solution of hydrated $Al_2O_3$ , and the dispersion was filtered and dried at 100° C. to obtain $Al_2O_3$-coated titanium oxide fine particles. The particles were again wet ground in a water solvent. After coarse particles were removed, the particles were treated with isobutyltrimethoxysilane, filtered, washed with water, dried at 70° C., and dry ground to obtain additive F.

| | |
|---|---|
| Additive F-(1): | $Al_2O_3$ coating weight = 0.8%; isobutyltrimethoxysilane = 10% |

Preparation of Additive G:

Titanium oxide fine particles obtained by the above-described technique were calcined, wet ground, and classified to remove coarse particles. To the resulting titanium oxide fine particles was added a diluted solution of hydrated $Al_2O_3$, and the dispersion was filtered and dried at 250° C. to obtain $Al_2O_3$-coated titanium oxide fine particles. The particles were again wet ground in a water solvent. After coarse particles were removed, the particles were treated with isobutyltrimethoxysilane, filtered, washed with water, dried at 120° C., and dry ground to obtain additive G.

| | |
|---|---|
| Additive G-(1): | $Al_2O_3$ coating weight = 0.8%; isobutyltrimethoxysilane = 10% |

Preparation of Additive H:

Titanium oxide fine particles obtained by the above-described technique were calcined, wet ground, and classified to remove coarse particles. After pH adjustment, the resulting titanium oxide fine particles were treated with isobutyltrimethoxysilane, followed by filtration, washing, drying at 100° C. and dry grinding, to obtain additive H.

| | |
|---|---|
| Additive H-(1): | Isobutylbtrimethoxysilane = 10% |

Preparation of Additive I:

Titanium oxide fine particles obtained by the above-described technique were calcined, and methylhydrogensilicone oil was sprayed on the particles in a dry process, and the coated particles were heat-treated at 150° C. and dry ground to obtain additive I.

| | |
|---|---|
| Additive I-(1): | methylhydrogensilicone oil = 20% |

Preparation of Additive J:

Titanium oxide fine particles obtained by the above-described technique were calcined, wet ground, and classified to remove coarse particles. A diluted solution of hydrated $Al_2O_3$ was added thereto, and the dispersion was filtered and dried at 100° C. to obtain $Al_2O_3$-coated titanium oxide fine particles, which were then dry ground to obtain additive J.

| | |
|---|---|
| Additive J-(1): | $Al_2O_3$ coating weight = 0.8% |

Preparation of Additive K:

Titanium oxide fine particles obtained by the above-described technique were calcined, wet ground, and classified to remove coarse particles. A diluted solution of hydrated $Al_2O_3$ was added thereto, and the dispersion was filtered and dried at 100° C. to obtain $Al_2O_3$-coated titanium oxide fine particles. The particles were again wet ground in a water solvent, and coarse particles were removed. The resulting particles were treated with decyltrimethoxysilane and lauric acid, followed by filtration, washing with water, drying at 100° C., and dry grinding to obtain additive K.

The following additives were prepared in accordance with the above method.

| | |
|---|---|
| Additive K-(1): | $Al_2O_3$ coating weight = 0.8%; decyltrimethoxysilane = 10%; lauric acid = 3% |
| Additive K-(2): | $Al_2O_3$ coating weight = 0.8%; decyltrimethoxysilane = 10%; lauric acid = 5% |
| Additive K-(3): | $Al_2O_3$ coating weight = 0.8%; decyltrimethoxysilane = 10%; lauric acid = 10% |

Preparation of Additive L:

Titanium oxide fine particles obtained by the above-described technique were calcined, wet ground, and classified to remove coarse particles. To the resulting titanium oxide fine particles was added aluminum sulfate. Subsequently, isobutyltrimethoxysilane and methyl stearate were added thereto, followed by filtration, washing with water, drying at 100° C., and dry grinding to obtain additive L.

| | |
|---|---|
| Additive L-(1): | $Al_2O_3$ coating weight = 0.8%; isobutyltrimethoxysilane = 10%; methyl stearate = 5% |
| Additive L-(2): | $Al_2O_3$ coating weight = 0.8%; isobutyltrimethoxysilane = 10%; methyl stearate = 2% |

Preparation of Additive M:

Additive M was prepared in the same manner as for additive L except for replacing isobutyltrimethoxysilane with dimethyldichlorosilane and replacing methyl stearate with palmitic acid.

| | |
|---|---|
| Additive M-(1): | $Al_2O_3$ coating weight = 0.8%; dimethyldichlorosilane = 10%; palmitic acid = 3% |

EXAMPLE 1

Preparation of Toner Particles:

| | |
|---|---|
| Binder resin (bisphenol type polyester resin; weight average molecular weight: 177000; number average molecular weight: 5800; Tg: 65° C.) | 100 parts |
| Phthalocyanine pigment | 5 parts |
| Charge control agent (Bontron E84) | 2 parts |

The above components were melt-kneaded in a Banbury mixer. After cooling, the blend was finely ground in a jet mill and classified to obtain toner particles having an average particle size of 7 μm. A hundred parts of the toner particles and 1.0 part of additive A-(1) were mixed in a Henschel mixer to prepare a toner.

Preparation of Carrier:

Ferrite powder having an average particle size of 50 μm was coated with a silicone resin (KR 250, produced by Shin-Etsu Chemical Co., Ltd.) in a kneader to obtain a carrier having a 0.8% coating layer.

Preparation of Developer:

Five parts of the toner and 95 parts of the carrier were mixed in a twin-cylinder mixer to prepare a two-component developer.

EXAMPLES 2 TO 12 AND COMPARATIVE EXAMPLES 1 TO 4

Developers were prepared in the same manner as in Example 1 except for replacing additive A-(1) used in Example 1 with the additives shown in Table 1 below, respectively.

Comparative Example 5

A developer was prepared in the same manner as in Example 1 except for replacing additive A-(1) with a combination of 0.5 part of hydrophobic silica (R972) and 0.5 part of titanium oxide (P25).

Comparative Example 6

A developer was prepared in the same manner as in Example 1 except for replacing additive A-(1) with 1 part of hydrophobic amorphous titanium oxide (a-$TiO_2$).

Details of the additives used in the foregoing are shown in Table 1 below.

TABLE 1

| Example No. | Additive | $Al_2O_3$ Coating Weight (%) | Treating Agent Kind[1)] | Treating Agent Amount (%) | BET Surface Area[2)] ($m^2/g$) |
|---|---|---|---|---|---|
| Example 1 | A-(1) | 0.1 | alkylsilane #1 | 10 | 100 |
| Example 2 | A-(2) | 0.8 | alkylsilane #1 | 10 | 100 |
| Example 3 | A-(3) | 2.0 | alkylsilane #1 | 10 | 100 |
| Example 4 | B-(1) | 1.0 | $C_8F_{17}SO_3NH_4$ | 20 | 100 |
| Example 5 | B-(2) | 0.2 | $C_8F_{17}SO_3NH_4$ | 5 | 95 |
| Example 6 | B-(3) | 2.0 | $C_8F_{17}SO_3NH_4$ | 20 | 105 |
| Example 7 | B-(4) | 2.0 | $C_8F_{17}SO_3NH_4$ | 50 | 90 |
| Example 8 | C-(1) | 1.0 | MHSi oil #2 | 20 | 100 |
| Example 9 | D-(1) | 1.0 | Rf betaine #3 | 20 | 100 |
| Example 10 | E-(1) | 1.0 | MHSi oil #2 | 20 | 80 |
| Example 11 | F-(1) | 0.8 | alkylsilane #1 | 10 | 100 |
| Example 12 | G-(1) | 0.8 | alkylsilane #1 | 10 | 75 |
| Compara. Example 1 | A-(4) | 2.5 | alkylsilane #1 | 10 | 100 |
| Compara. Example 2 | H-(1) | — | alkylsilane #1 | 10 | 100 |
| Compara. Example 3 | I-(1) | — | MHSi oil #2 | 20 | 60 |
| Compara. Example 4 | J-(1) | 0.8 | — | — | 95 |
| Compara. Example 5 | R972/P25 | — | DM #4/- | | 110/50 |
| Compara. Example 6 | a-$TiO_2$ | — | alkylsilane #1 | 10 | 85 |

Note:
1): Treating agent:
#1: Isobutyltrimethoxysilane
#2: Methylhydrogensilicone oil
#3: Perfluoroalkylbetaine
#4: Dimethyldichlorosilane
2): Measured with a Betasorb automatic Surface area analyzer (Model 4200, manufactured by Nikkiso K.K.) using nitrogen-helium mixed gas. (BET surface areas shown below are also measured in the same manner.)

A copy test was carried out using the developers prepared in Examples 1 to 12 and Comparative Examples 1 to 6 on a copying machine (A-COLOR 635, manufactured by Fuji Xerox Co., Ltd.) in a high temperature and high humidity environment (30° C., 90%) and a low temperature and low humidity environment (5° C., 10%) to make 200,000 copies in each environment. The performance of the toners and developers was evaluated as follows. The results of the evaluations are shown in Table 2 below.

1) Toner Fluidity:

The fluidity of the toner was evaluated by using an off-line Auger dispenser. The objective amount to be dispensed is 700 mg/sec or more.

2) Caking Resistance of Toner:

The toner having been stored at 50° C. for 24 hours was put on a net having a mesh size of 105 μm, and certain vibrations were given to the net. The toner agglomerates remaining on the net was weighed to determine a degree of agglomeration ((weight of the residue on the net (105 μm)/weight of the total toner)×100(%)). The objective degree of agglomeration is 20% or less.

3) Charge Quantity:

The developer was allowed to stand in the respective environments for 24 hours, and the initial charge quantity was measured with a blow-off type charge quantity detector TB200 (manufactured by Toshiba Corp.) at 25° C. and 55% RH. The charge quantity after taking 200,000 copies was also measured in the same manner.

4) Overall Evaluation on Charging Properties:

Environmental dependence of charging properties was evaluated in terms of ((initial charge quantity in a high temperature and high humidity environment)/(initial charge quantity in a low temperature and low humidity environment)+(charge quantity after taking 200,000 copies in a high temperature and high humidity environment)/(charge quantity after taking 200,000 copies in a low temperature and low humidity environment))×½. The resulting values were graded according to the following criteria.

≧0.7 . . . Good

≧0.5 . . . Medium

<0.5 . . . Poor

Durability of the charging properties was evaluated in terms of ((charge quantity after taking 200,000 copies in a high temperature and high humidity environment)/(initial charge quantity in a high temperature and high humidity environment)+(charge quantity after taking 200,000 copies in a low temperature and low humidity environment)/(initial charge quantity in a low temperature and low humidity environment))×½. The resulting values were graded according to the following criteria.

≧0.7 . . . Good

≧0.5 . . . Medium

<0.5 . . . Poor

TABLE 2

| Example No. | Toner Fluidity (mg/sec) | Toner Caking Resistance (%) | Initial Charge Quantity (μC/g) Envl[1)] | Initial Charge Quantity (μC/g) Env2[2)] | Charge Quanitity After Taking 200,000 Copies (μC/g) Env1 | Charge Quanitity After Taking 200,000 Copies (μC/g) Env2 | Overall Evalulation of Charging Properties: Environmental Dependence | Overall Evalulation of Charging Properties: Durability | Image Defects[3)] |
|---|---|---|---|---|---|---|---|---|---|
| Example 1 | 770 (pass) | 7 (pass) | −30 | −35 | −13 | −20 | good | medium | *1 |
| Example 2 | 800 (pass) | 6 (pass) | −25 | −30 | −23 | −28 | good | good | none |
| Example 3 | 800 (pass) | 7 (pass) | −15 | −20 | −20 | −23 | good | good | none |
| Example 4 | 830 (pass) | 3 (pass) | −28 | −30 | −28 | −32 | good | good | none |
| Example 5 | 770 (pass) | 10 (pass) | −18 | −20 | −10 | −15 | good | medium | *1 |
| Example 6 | 830 (pass) | 3 (pass) | −18 | −22 | −18 | −23 | good | good | none |
| Example 7 | 750 (pass) | 15 (pass) | −32 | −38 | −30 | −35 | good | good | none |
| Example 8 | 800 (pass) | 5 (pass) | −28 | −33 | −25 | −38 | good | good | none |
| Example 9 | 810 (pass) | 3 (pass) | −26 | −28 | −25 | −27 | good | good | none |
| Example 10 | 720 (pass) | 12 (pass) | −25 | −30 | −23 | −35 | good | good | none |
| Example 11 | 800 (pass) | 5 (pass) | −25 | −30 | −15 | −20 | good | medium | none |
| Example 12 | 700 (pass) | 18 (pass) | −23 | −28 | −22 | −26 | good | good | none |
| Compara. Example 1 | 800 (pass) | 8 (pass) | −8 | −18 | −8 | −20 | poor | good | *2 |
| Compara. Example 2 | 810 (pass) | 8 (pass) | −32 | −36 | −6 | −8 | good | poor | *3 |
| Compara. Example 3 | 600 (fail) | 50 (fail) | −35 | −40 | −5 | −7 | good | poor | *4 |
| Compara. Example 4 | 680 (fail) | 30 (fail) | +5 | +8 | +3 | +5 | — | — | *5 |
| Compara. Example 5 | 720 (pass) | 25 (fail) | −23 | −30 | −5 | −25 | poor | medium | *6 |
| Compara. Example 6 | 700 (pass) | 25 (fail) | −28 | −35 | −3 | −8 | medium | poor | *7 |

Note:

1): High temperature and high humidity environment

2): Low temperature and low humidity environment

3): Image Defect:

TABLE 2-continued

*1: The image quality was acceptable while some dirt developed in a high temperature and high humidity environment.
*2: Poor fine line reproduction and fog due to low chargeability occurred from the initial stage in a high temperature and high humidity environment.
*3: Reduction in image density reproduction and fog occurred remarkably from the stage after obtaining about 10,000 copies.
*4: The toner clogged due to disorder of the toner dispenser in a high temperature and high humidity environment. Reduction in image density reproduction and fog occurred remarkably from the stage after obtaining about 10,000 copies.
*5: No image was obtained from the very beginning due to charging to opposite polarity.
*6: Reduction in image density reproduction and fog occurred remarkably from the stage after obtaining about 3,000 copies in a high temperature and high humidity environment. Toner clogging due to disorder of the toner dispenser occurred several times from the same stage.
*7: Reduction in image density reproduction and fog occurred remarkably from the stage after obtaining about 10,000 copies. Toner clogging due to disorder of the toner dispenser occurred several times from the same stage. Unevenness in halftone density due to scratches on the photoreceptor began to develop after about 1,000 copies were taken.

EXAMPLE 13

Preparation of Toner Particles:

| | |
|---|---|
| Binder resin (bisphenol type polyester resin; weight average molecular weight: 177000; number average molecular weight: 5800; Tg: 65° C.) | 100 parts |
| Magnetic powder (hexagonal magnetite) | 100 parts |
| Charge control agent (iron azo complex compound; T77, produced by Hodogaya Chemical Co., Ltd.) | 2 parts |
| Release agent (low-molecular polypropylene Viscol 660P, produced by Sanyo Chemical Industries, Ltd.) | 3 parts |

The above components were melt-kneaded in an extruder and, after cooling, finely ground in a jet mill, followed by classification to obtain toner particles having an average particle size of 7 μm. A hundred parts of the toner particles and 1.0 part of additive A-(2) were blended in a Henschel mixer to prepare a toner.

EXAMPLES 14 AND 15

Developers were prepared in the same manner as in Example 13 except for replacing additive A-(2) with additive A-(3) (Example 14) and additive C-(1) (Example 15), respectively.

Comparative Examples 7 to 9

Developers were prepared in the same manner as in Example 13 except for replacing additive A-(2) with additive I-(1) (Comparative Example 7), hydrophobic amorphous titanium oxide (a-$TiO_2$) (Comparative Example 8) and hydrophobic silica (R972) (Comparative Example 9), respectively.

Details of the additives used in Examples 13 to 15 and Comparative Examples 7 to 9 are shown in Table 3 below.

TABLE 3

| Example No. | Additive | $Al_2O_3$ Coating Weight (%) | Treating Agent Kind | Treating Agent Amount (%) | BET Surface Area ($m^2/g$) |
|---|---|---|---|---|---|
| Example 13 | A-(2) | 0.8 | alkylsilane #1 | 10 | 100 |
| Example 14 | A-(3) | 2.0 | alkylsilane #1 | 10 | 100 |
| Example 15 | C-(1) | 1.0 | MHSi oil #2 | 20 | 100 |

TABLE 3-continued

| Example No. | Additive | $Al_2O_3$ Coating Weight (%) | Treating Agent Kind | Treating Agent Amount (%) | BET Surface Area ($m^2/g$) |
|---|---|---|---|---|---|
| Compara. Example 7 | I-(1) | — | MHSi oil #2 | 20 | 60 |
| Compara. Example 8 | a-$TiO_2$ | — | alkylsilane #1 | 10 | 85 |
| Compara. Example 9 | R972 | — | DM #4 | | 110 |

Note:
#1: Isobutyltrimethoxysilane
#2: Methylhydrogensilicone oil
#4: Dimethyldichlorosilane A copying test was carried out using each of the developers prepared in Examples 13 to 15 and Comparative Examples 7 to 9 on a copying machine (Able 3200, manufactured by Fuji Xerox Co., Ltd.) in a high temperature and high humidity environment (30° C., 90% RH) and a low temperature and low humidity environment (5° C. , 10% RH) to take 20,000 copies in each environment. The performance of the toners and developers was evaluated as follows. The results of the evaluations are shown in Table 4 below.

1) Toner Fluidity:

The fluidity of the toner was evaluated in the same manner as in Example 1. The objective amount to be dispensed is 1000 mg/sec or more.

2) Caking Resistance of Toner:

The caking resistance of the toner was tested in the same manner as in Example 1. The objective degree of agglomeration is 20% or less.

3) Charge Quantity:

The toner was transported to the sleeve and allowed to stand in the respective environments for 24 hours. The initial charge quantity was measured by suction tribometry in each environment. The charge quantity after taking 20,000 copies was also measured in the same manner.

4) Overall Evaluation on Charging Properties:

Environmental dependence of charging properties was evaluated in terms of ((initial charge quantity in a high temperature and high humidity environment)/(initial charge quantity in a low temperature and low humidity environment)+(charge quantity after taking 20,000 copies in a high temperature and high humidity environment)/(charge quantity after taking 20,000 copies in a low temperature and low humidity environment))×½. The resulting values were graded according to the following criteria.

≧0.7 . . . Good

≧0.5 . . . Medium

<0.5 . . . Poor

Durability of the charging properties was evaluated in terms of ((charge quantity after taking 20,000 copies in a high temperature and high humidity environment)/(initial charge quantity in a high temperature and high humidity environment)+(charge quantity after taking 20,000 copies in a low temperature and low humidity environment)/(initial charge quantity in a low temperature and low humidity environment))×½. The resulting values were graded according to the following criteria.

≧0.7 . . . Good

≧0.5 . . . Medium

<0.5 . . . Poor

TABLE 4

| Example No. | Toner Fluidity (mg/sec) | Toner Caking Resistance (%) | Initial Charge Quantity (μC/g) Env1[1)] | Initial Charge Quantity (μC/g) Env2[2)] | Charge Quantity After Taking 20,000 Copies (μC/g) Env2 | Charge Quantity After Taking 20,000 Copies (μC/g) Env2 | Overall Evaluation of Charging Properties: Environmental Dependence | Overall Evaluation of Charging Properties: Durability | Image Defects[3)] |
|---|---|---|---|---|---|---|---|---|---|
| Example 13 | 1200 (pass) | 8 (pass) | −12 | −16 | −15 | −17 | good | good | none |
| Example 14 | 1200 (pass) | 10 (pass) | −7 | −10 | −8 | −12 | medium | good | none |
| Example 15 | 1250 (pass) | 7 (pass) | −10 | −13 | −10 | −15 | good | good | none |
| Compara. Example 7 | 850 (fail) | 35 (fail) | −15 | −18 | −3 | −5 | good | poor | *1 |
| Compara. Example 8 | 1000 (pass) | 30 (fail) | −8 | −10 | −2 | −3 | good | poor | *2 |
| Compara. Example 9 | 1300 (pass) | 3 (pass) | −3 | −20 | −7 | −30 | poor | good | *3 |

Note:

1): High temperature and high humidity environment

2): Low temperature and low humidity environment

3): Image Defects:

*1: Developing performance began to reduce after about 2,000 copies were taken in both environments. White streaks on the sleeve due to toner agglomeration began to appear on the images after obtaining about 500 copies in a high temperature and high humidity environment.

*2: Developing performance began to reduce after about 1,000 copies were taken in both environments. White streaks on the sleeve due to toner agglomeration and to adhesion of the additive began to appear on the images after obtaining about 1500 copies in a high temperature and high humidity environment.

*3: Reduction in developing performance was observed from the initial stage of copying in a high temperature and high humidity environment. Low image density which seems ascribable to slow charging was observed on taking copies of a black solid image from the initial stage after sleeve's making two rotations in a low temperature and low humidity environment. When copying a letter image is followed by copying a black solid image or a halftone image, the preceding letter image appeared faintly on the following image (a ghost phenomenon). White spots began to appear on images obtained after taking about 8000 copies in both environments.

EXAMPLE 16

Preparation of Toner Particles:

| | |
|---|---|
| Binder resin (styrene-n-butyl methacrylate copolymer (80:20); weight average molecular weight: 150000; number average molecular weight: 3700) | 100 parts |
| Magnetic powder (hexagonal magnetite) | 100 parts |
| Charge control agent (iron azo complex compound; T77, produced by Hodogaya Chemical Co., Ltd.) | 1 part |
| Release agent (low-molecular polypropylene Viscol 660P, produced by Sanyo Chemical Industries, Ltd.) | 3 parts |

The above components were melt-kneaded in an extruder and, after cooling, finely ground in a jet mill, followed by classification to obtain toner particles having an average particle size of 7 μm. A hundred parts of the toner particles and 1.0 part of additive A-(2) were blended in a Henschel mixer to prepare a toner (developer).

EXAMPLES 17 TO 22

Developers were prepared in the same manner as in Example 16 except for replacing additive A-(2) with the same part of the additives shown in Table 5 below, respectively.

Comparative Examples 10 and 11

Developers were prepared in the same manner as in Example 16 except for replacing additive A-(2) with a combination of 0.5 part of hydrophobic silica (R972) and 0.5 part of titanium oxide (P25) (Comparative Example 10) or 1.0 part of titanium oxide (P25) (Comparative Example 11), respectively.

Details of the additives used in Examples 16 to 22 and Comparative Examples 10 and 11 are shown in Table 5 below.

TABLE 5

| Example No. | Additive | $Al_2O_3$ Coating Weight (%) | Treating Agent Kind[1)] | Treating Agent Amount (%) | Fatty Acid or Fatty Acid Ester Kind | Fatty Acid or Fatty Acid Ester Amount (%) | BET Surface Area ($m^2/g$) |
|---|---|---|---|---|---|---|---|
| Example 16 | A-(2) | 0.8 | alkylsilane #1 | 10 | — | — | 100 |
| Example 17 | K-(1) | 0.8 | alkylsilane #2 | 10 | lauric acid | 3 | 90 |
| Example 18 | K-(2) | 0.8 | alkylsilane #2 | 10 | lauric acid | 5 | 87 |
| Example 19 | K-(3) | 0.8 | alkylsilane #2 | 10 | lauric acid | 10 | 80 |
| Example 20 | L-(1) | 0.8 | alkylsilane #1 | 10 | methyl stearate | 5 | 88 |
| Example 21 | L-(2) | 0.8 | alkylsilane #1 | 10 | methyl stearate | 2 | 92 |
| Example 22 | M-(1) | 0.8 | alkylsilane #3 | 10 | palmitic acid | 3 | 95 |
| Compara. Example 10 | R972/P25 | — | DM #4/- | — | — | — | 110/50 |
| Compara. Example 11 | P25 | — | — | — | — | — | 50 |

Note:
1) Treating agent:
#1: Isobutyltrimethoxysilane
#2: Decyltrimethoxysilane
#3: Dimethyldichlorosilan
#4: Dimethyldichlorosilane A copying test was carried out using each of the developers prepared in Examples 16 to 22 and Comparative Examples 10 and 11 on a copying machine (Able 3321, manufactured by Fuji Xerox Co., Ltd.) in a high temperature and high humidity environment (30° C., 90% RH) and a low temperature and low humidity environment (5° C., 10% RH) to take 20,000 copies in each environment. The performance of the developers (toners) was evaluated as follows. The results of the evaluations are shown in Table 6 below.

1) Toner Fluidity:

The fluidity of the toner was evaluated in the same manner as in Example 1. The objective amount to be dispensed is 1000 mg/sec or more.

2) Caking Resistance of Toner:

The caking resistance of the toner was tested in the same manner as in Example 1. The objective degree of agglomeration is 20% or less.

3) Charge Quantity:

The initial charge quantity and the charge quantity after taking 20,000 copies were measured in the same manner as in Example 13.

4) Overall Evaluation on Charging Properties:

Environmental dependence and durability of the charging properties were evaluated and graded in the same manner as in Example 13.

5) Wear of Photoreceptor:

The thickness of the surface resin layer of the photoreceptor was measured with a laser profilometer at more than 50 points before the copying test to obtain an average initial thickness. The same measurement was made after taking 20,000 copies to obtain an average thickness. The difference between the average initial thickness and the average thickness after taking 20,000 copies was taken as a wear. The objective value of wear is not more than 22 μm.

TABLE 6

| Example No. | Toner Fluidity (mg/sec) | Toner Caking Resistance (%) | Initial Charge Quantity (μC/g) Env1[1)] | Initial Charge Quantity (μC/g) Env2[2)] | Charge Quantity After Taking 20,000 Copies (μC/g) Env1 | Charge Quantity After Taking 20,000 Copies (μC/g) Env2 | Overall Evaluation of Charging Properties: Environmental Dependence | Overall Evaluation of Charging Properties: Durability | Wear of Photoreceptor After Taking 20,000 Copies (μm) Env1 | Wear of Photoreceptor After Taking 20,000 Copies (μm) Env2 | Image Defects[3)] |
|---|---|---|---|---|---|---|---|---|---|---|---|
| Example 16 | 1400 (pass) | 8 (pass) | −15 | −17 | −16 | −18 | good | good | 18 | 22 | none |
| Example 17 | 1300 (pass) | 10 (pass) | −20 | −23 | −18 | −20 | good | good | 13 | 15 | none |
| Example 18 | 1200 (pass) | 12 (pass) | −21 | −23 | −22 | −25 | good | good | 10 | 13 | none |
| Example 19 | 1100 (pass) | 15 (pass) | −22 | −25 | −23 | −26 | good | good | 8 | 10 | none |
| Example 20 | 1250 (pass) | 10 (pass) | −16 | −17 | −16 | −18 | good | good | 9 | 13 | none |
| Example 21 | 1350 (pass) | 6 (pass) | −15 | −17 | −16 | −17 | good | good | 16 | 20 | none |
| Example 22 | 1300 (pass) | 7 (pass) | −12 | −15 | −10 | −13 | good | good | 14 | 15 | none |
| Compara. Example 10 | 1350 (pass) | 5 (pass) | −10 | −15 | −3 | −12 | poor | medium | 20 | 23 | *1 |
| Compara. | 750 | 35 | −5 | −8 | −2 | −6 | poor | medium | 25 | 30 | *2 |

TABLE 6-continued

| | | |
|---|---|---|
| Example 11 | (fail) | (fail) |

Note:
1): High temperature and high humidity environment
2): Low temperature and low humidity environment
3): Image defects:
#1: Developing properties reduced after taking about 500 copies in a high temperature and high humidity environment. White spots and black spots caused by scratches on the photoreceptor appeared on halftone images. The charging was slow in taking copies of a black solid image from the initial stage in a low temperature and low humidity environment, and low image density which seems ascribable to insufficient toner feed onto the sleeve developed after sleeve's making two rotations. When copying a letter image is followed by copying a black solid image or a halftone image, the preceding letter image appeared faintly on the following image (a ghost phenomenon).
#2: Developing properties were low from the initial stage in a high temperature and high humidity environment. After taking about 10,000 copies in a low temperature and low humidity environment, reduction in developing potential due to wear of the photoreceptor was observed, and the developing properties were reduced.

Carriers used in the following Examples 23 to 27 and Comparative Examples 12 to 14 were prepared as follows.

Preparation of Carrier A:

Twenty parts of organopolysiloxane represented by formula (I-1):

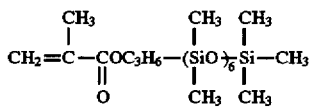

(I-1)

25 parts of n-butyl acrylate, and 55 parts of methyl methacrylate were copolymerized to obtain a silicone-modified acrylic resin (a) having a weight average molecular weight of 50,000.

In 300 parts of toluene were dispersed 1000 parts of Cu—Zn ferrite powder (a product of Powder Tec; average particle size: 50 μm) and 10 parts of silicone-modified acrylic resin (a). The dispersion was stirred in a 5 l-volume kneader equipped with a heater at 70° C. (heating medium temperature) for 10 minutes. The temperature of the heating medium was then raised to 110° C., and heating was continued for 30 minutes under reduced pressure. The heater was switched off, and the mixture was further stirred for 30 minutes to cool. The resulting was then sifted through a 105 μm sieve to obtain carrier A.

Figure 2:
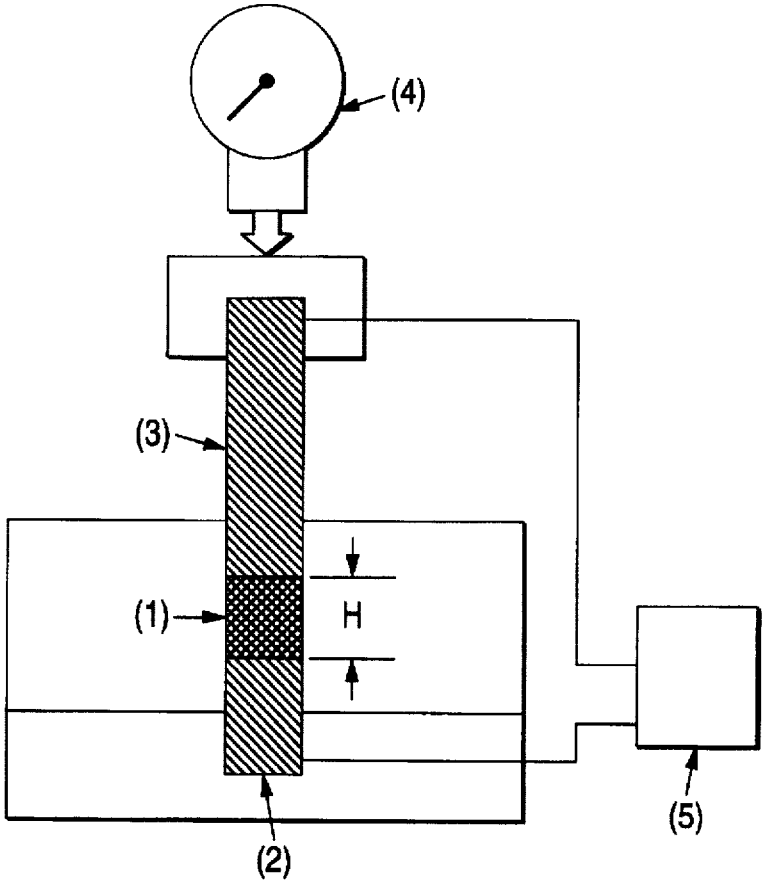
FIG. 2 is a schematic illustration of equipment used for measurement of volume resistivity and breakdown voltage of a carrier.

Carrier A had a volume resistivity of $10^9$ Ω.cm at an applied voltage of $10^{3.8}$ V. The volume resistivity of a carrier was measured with the equipment shown in FIG. 2, in which the resistivity of sample (1) held by lower electrode (2) and upper electrode (3) under pressure as controlled by dial gauge (4) is measured with high-voltage resistometer (5).

Preparation of Carrier B:

Twenty-five parts of organopolysiloxane represented by formula (I-2):

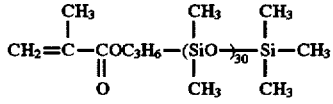

(I-2)

25 parts of styrene, and 50 parts of methyl methacrylate were copolymerized to obtain a silicone-modified acrylic resin (b) having a weight average molecular weight of 45,000.

In 300 parts of toluene were dispersed 1000 parts of Cu—Zn ferrite powder (a product of Powder Tec; average particle size: 50 μm) and 15 parts of silicone-modified acrylic resin (b). The dispersion was stirred in a 5 l-volume kneader equipped with a heater at 70° C. (heating medium temperature) for 10 minutes. The temperature of the heating medium was then raised to 110° C., and heating was continued for 30 minutes under reduced pressure. The heater was switched off, and the mixture was further stirred for 30 minutes to cool. The resulting was sifted through a 105 μm sieve to obtain carrier B. Carrier B had a volume resistivity of $10^{12}$ Ω.cm at an applied voltage of $10^{3.8}$ V.

Preparation of Carrier C:

Fifteen parts of the organopolysiloxane represented by formula (I-1), 20 parts of n-butyl acrylate, 60 parts of methyl methacrylate, and 5 parts of organosilane represented by formula (II-1):

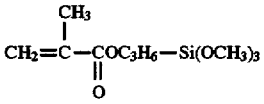

(II-1)

were copolymerized to obtain a silicone-modified acrylic resin (c) having a weight average molecular weight of 45,000.

In a mixed solvent of 300 parts of toluene and 10 parts of methanol were dispersed 1000 parts of Cu—Zn ferrite powder (a product of Powder Tec; average particle size: 50 μm), 7 parts of silicone-modified acrylic resin (c), and 0.1 part of γ-aminopropyltriethoxysilane. The dispersion was stirred in a 5 l-volume kneader equipped with a heater at 70° C. (heating medium temperature) for 10 minutes. The temperature of the heating medium was then raised to 150° C., and heating was continued for 30 minutes under reduced pressure. The heater was switched off, and the mixture was further stirred for 60 minutes to cool. The resulting was sifted through a 105 μm sieve to obtain carrier C. The volume resistivity of carrier C was $10^7$ Ω.cm at an applied voltage of $10^{3.8}$ V.

Preparation of Carrier D:

In 300 parts of toluene were dispersed 1000 parts of Cu—Zu ferrite powder (a product of Powder Tec; average particle size: 50 μm) and 20 parts of a cold-setting silicone resin (KR255, produced by Shin-Etsu Chemical Co., Ltd.). The dispersion was stirred in a 5 l-volume header equipped with a heater at 70° C. (heating medium temperature) for 10 minutes. The temperature of the heating medium was then raised to 180° C., and heating was continued for 30 minutes under reduced pressure. The heater was switched off, and the mixture was further stirred for 60 minutes to cool. The resulting was shifted through a 105 μm sieve to obtain carrier D. The volume resistivity of carrier D was $10^{15}$ Ω.cm at an applied voltage of $10^{3.8}$ V.

Preparation of Carrier E:

Twenty parts of n-butyl acrylate, 80 parts of methyl methacrylate were copolymerized to obtain acrylic resin (d) having a weight average molecular weight of 55,000.

In 300 parts of toluene were dispersed 1000 parts of Cu—Zu ferrite powder (a product of Powder Tec; average particle size: 50 μm), 5 parts of acrylic resin (d), and 10 parts of a cold-setting silicone resin (KR255, produced by Shin-Etsu Chemical Co., Ltd.). The dispersion was stirred in a 5 l-volume kneader equipped with a heater at 70° C. (heating medium temperature) for 10 minutes. The temperature of the heating medium was then raised to 150° C., and heating was continued for 30 minutes under reduced pressure. The heater was switched off, and the mixture was further stirred for minutes to cool. The resulting was sifted through a 105 μm sieve to obtain carrier E. The volume resistivity of carrier D was $10^{10}$ Ω.cm at an applied voltage of $10^{3.8}$ V.

EXAMPLE 23

Preparation of Toner Particles:

| | |
|---|---|
| Binder resin (bisphenol A type polyester resin; weight average molecular weight: 177000; number average molecular weight: 5800; Tg: 65° C.) | 87 parts |
| Carbon black (BLP, produced by Cabot G.L. Inc.) | 8 parts |
| Charge control agent (TRH, produced by Hodogaya Chemical Co., Ltd.) | 1 part |
| Polypropylene wax (660P, produced by Sanyo Chemical Industries, Ltd.) | 4 parts |

The above components were melt-kneaded in a Banbury mixer and, after cooling, finely ground in a jet mill, followed by classification to obtain toner particles having an average particle size of 7.5 μm. A hundred parts of the toner particles and 1.0 part of additive A-(2) were blended in a Henschel mixer to prepare a toner.

Preparation of Developer:

Five parts of the above toner and 95 parts of carrier A were blended in a twin-cylinder mixer to prepare a two-component developer.

EXAMPLES 24 TO 27

Developers were prepared in the same manner as in Example 23 except for replacing carrier A with Carrier B, C, D and E, respectively.

Comparative Examples 12 to 14

Developers were prepared in the same manner as in Example 23 except for replacing additive A-(2) with the same amount of hydrophobic amorphous titanium oxide (Comparative Example 12), additive A-(4) (Comparative Example 13) and additive H-(1) (Comparative Example 14), respectively.

A copying test was carried out using each of the developers prepared in Examples 23 to 27 and Comparative Examples 12 to 14 on a copying machine (Model 5039 (reformed), manufactured by Fuji Xerox Co., Ltd.) in a high temperature and high humidity environment (30° C., 80% RH) and a low temperature and low humidity environment (5° C., 10% RH) to make an evaluation of image quality and to make a microscopic observation of the coating state on the carrier. After 500,000 copies were taken, tests of forced development and forced toner addition were conducted. The capability of the developer was confirmed from the resulting background stains and developing properties in the tests. Measurements and evaluations were made as follows. The results obtained are shown in Tables 7 and 8 below.

Image Characteristics:

Solid densities were measured with X-Rite 404A manufactured by X-Rite.

Background stains (fog) were graded according to the following criteria.

G1 . . . No problem.

G2 . . . Faint fog observed.

G3 . . . Slight fog observed.

G4 . . . Marked fog observed.

G5 . . . Considerable fog observed.

The objective grade is G2 or G1.

2) Toner Concentration Latitude (TCL):

Development was continued with no addition of the toner until the solid density fell below 0.5. The toner was stepwise added to increase the toner concentration by 1% based on the weight of the carrier, and the solid density and the fog grade were measured for each toner addition, and were plotted against the toner concentration (FIG. 1).

The toner concentration at which a solid density of 1.1 was reached was taken as TC(1). The toner concentration at which a solid density was 1.1 or higher and the fog became worse than G2 was taken as TC(2). The toner concentration latitude was determined as the difference between TC(2) and TC(1).

TABLE 7

| | Initial Stage of Copying | | | | | | | | | |
|---|---|---|---|---|---|---|---|---|---|---|
| | Environment 1* | | | | | Environment 2** | | | | |
| | | Image Characteristics | | | | | Image Characteristics | | | |
| Example No. | Charge Quantity (μC/g) | Solid Density | Back-ground Stains | TCL (%) | Carrier Surface Condition | Charge Quantity (μC/g) | Solid Density | Back-ground Stains | TCL (%) | Carrier Surface Condition |
| Example 23 | −18 | 1.50 | G1 | 9 | good | −20 | 1.52 | G1 | 10 | good |
| Example 24 | −16 | 1.48 | G1 | 10 | good | −17 | 1.50 | G1 | 12 | good |
| Example 25 | −20 | 1.52 | G1 | 11 | good | −22 | 1.52 | G1 | 11 | good |
| Example 26 | −12 | 1.42 | G1 | 5 | good | −13 | 1.48 | G2 | 6 | good |
| Example 27 | −8 | 1.40 | G2 | 4 | good | −10 | 1.42 | G2 | 5 | good |
| Compara. Example 12 | −25 | 1.38 | G1 | 10 | good | −30 | 1.38 | G1 | 7 | good |
| Compara. Example 13 | −6 | 1.10 | G3 | 2 | good | −7 | 1.15 | G3 | 3 | good |
| Compara. Example 14 | −21 | 1.43 | G1 | 8 | good | −23 | 1.40 | G1 | 6 | good |

TABLE 7-continued

| Initial Stage of Copying | | | | | | | | | | |
|---|---|---|---|---|---|---|---|---|---|---|
| | Environment 1* | | | | | Environment 2** | | | | |
| | Image Characteristics | | | | | Image Characteristics | | | | |
| Example No. | Charge Quantity (μC/g) | Solid Density | Back-ground Stains | TCL (%) | Carrier Surface Condition | Charge Quantity (μC/g) | Solid Density | Back-ground Stains | TCL (%) | Carrier Surface Condition |

Note:
*High temperature and high humidity environment
**Low temperature and low humidity environment

TABLE 8

| After Taking 500,000 Copies | | | | | | | | | | |
|---|---|---|---|---|---|---|---|---|---|---|
| | Environment 1* | | | | | Environment 2** | | | | |
| | Image Characteristics | | | | | Image Characteristics | | | | |
| Example No. | Charge Quantity (μC/g) | Solid Density | Back-ground Stains | TCL (%) | Carrier Surface Condition | Charge Quantity (μC/g) | Solid Density | Back-ground Stains | TCL (%) | Carrier Surface Condition |
| Example 23 | −20 | 1.50 | G1 | 8 | good | −22 | 1.52 | G1 | 12 | good |
| Example 24 | −16 | 1.50 | G1 | 12 | good | −18 | 1.52 | G1 | 10 | good |
| Example 25 | −21 | 1.52 | G1 | 10 | good | −23 | 1.50 | G1 | 8 | good |
| Example 26 | −13 | 1.48 | G1 | 4 | worn | −15 | 1.49 | G2 | 4 | worn |
| Example 27 | −10 | 1.40 | G2 | 4 | worn | −12 | 1.42 | G2 | 3 | worn |
| Compara. Example 12 | −6 | 0.90 | G3 | 0 | good | −5 | 0.85 | G4 | 0 | good |
| Compara. Example 13 | −7 | 0.95 | G3 | 0 | good | −8 | 0.90 | G3 | 0 | good |
| Compara. Example 14 | −3 | 0.48 | G4 | 0 | good | −5 | 0.50 | G5 | 0 | good |

EXAMPLE 28

A stainless steel-made developing roll sleeve for a laser printer Able 3015 (manufactured by Fuji Xerox Co., Ltd.) was dip coated with a dispersion of 100 parts of silicone-modified resin (a) and 30 parts of carbon black in toluene to form 50 g/m$^2$ of a resin coating layer.

Preparation of Toner Particles:

| | |
|---|---|
| Binder resin (styrene-n-butyl methacrylate copolymer (80:20); weight average molecular weight: 130000) | 44 parts |
| Magnetic powder (EPT-1000, produced by Toda Kogyo Corp.) | 50 parts |
| Charge control agent (TRH, produced by Hodogaya Chemical Co., Ltd.) | 2 parts |
| Polypropylene wax (660P, produced by Sanyo Chemical Industries, Ltd.) | 4 parts |

The above components were melt-kneaded in a Banbury mixer and, after cooling, finely ground in a jet mill, followed by classification to obtain toner particles having an average particle size of 8.0 μm. A hundred parts of the toner particles and 1.0 part of additive A-(2) were blended in a Henschel mixer to prepare a toner.

EXAMPLE 29

A developing sleeve was dip coated in the same manner as in Example 28 except for replacing silicone-modified acrylic resin (a) with silicone-modified acrylic resin (b). A developer was prepared in the same manner as in Example 28 except for replacing additive A-(2) with additive D-(1).

The resin-coated developing roll sleeves and developers obtained in Examples 28 and 29 were, respectively, set in a laser printer (Able 3015). A copying test was carried out under a high temperature and high humidity condition (30° C., 80% RH). The image quality was evaluated, and the condition of the resin coating state of the sleeve was observed under an electron microscope. The results obtained are shown in Table 9 below. The solid densities in Table 9 were values measured with X-Rite. It is apparent from Table 9 that the image forming process of the invention provides images of stable quality.

TABLE 9

| Example No. | Initial Stage | | | After Taking 100,000 Copies | | |
|---|---|---|---|---|---|---|
| | Solid Density (Judgement) | Background Stains (Judgement) | Sleeve Surface Condition | Solid Density (Judgement) | Background Stains (Judgement) | Sleeve Surface Condition |
| Example 28 | 1.48 (good) | none (good) | good | 1.45 (good) | none (good) | good |
| Example 29 | 1.43 (good) | none (good) | good | 1.47 (good) | none (good) | good |

Preparation of Carrier F:

In a mixed solvent of 100 parts of methyl ethyl ketone and 200 parts of toluene were dispersed 1000 parts of Cu—Zu ferrite powder (a product of Powder Tec; average particle sizes 50 μm) and 5 parts of a copolymer comprising fluoroalkyl acrylate of formula: $CH_2{=}C(CH_3)COO(CH_2)_2C_8F_{17}$ and methyl methacrylate (20:80; weight average molecular weight: 62,000; number average molecular weight: 23,000). The dispersion was stirred in a 5 l-volume kneader equipped with a heater at 70° C. (heating medium temperature) for 10 minutes. The temperature of the heating medium was then raised to 110° C., and heating was continued for 30 minutes under reduced pressure. The heater was switched off, and the mixture was further stirred for 30 minutes to cool. The resulting was sifted through a 105 μm sieve to obtain carrier F. The volume resistivity of carrier F was $10^6$ Ω.cm at an applied voltage of $10^{3.8}$ V.

Preparation of Carrier G:

Carrier G was prepared in the same manner as for carrier F except for doubling the amount of the copolymer. The volume resistivity of carrier G was $10^9$ Ω.cm at an applied voltage of $10^{3.8}$ V.

Preparation of Carrier H:

Carrier H was prepared in the same manner as for carrier F except for increasing the amount of the copolymer to 13 parts. The volume resistivity of carrier H was $10^{12}$ Ω.cm at an applied voltage of $10^{3.8}$ V.

Preparation of Carrier I:

Carrier I was prepared in the same manner as for carrier F except for increasing the amount of the copolymer to 20 parts. The volume resistivity of carrier I was $10^{15}$ Ω.cm at an applied voltage of $10^{3.8}$ V.

EXAMPLE 30

Preparation of Toner Particles:

| | |
|---|---|
| Binder resin (bisphenol A type polyester resin; weight average molecular weight: 177000; number average molecular weight: 5800; Tg: 65° C.) | 100 parts |
| Phthalocyanine pigment | 5 parts |

-continued

| | |
|---|---|
| Charge control agent (Bontron E84) | 2 parts |

The above components were melt-kneaded in a Banbury mixer and, after cooling, finely ground in a jet mill, followed by classification to obtain toner particles having an average particle size of 7 μm. A hundred parts of the toner particles and 1.0 part of additive A-(2) were blended in a Henschel mixer to prepare a toner.

Preparation of Developer:

Five parts of the toner and 95 parts of carrier F were blended in a twin-cylinder mixer to prepare a two-component developer.

EXAMPLES 31 TO 34

Developers were prepared in the same manner as in Example 30 except for replacing carrier F with Carrier G, H, I and E, respectively.

Comparative Example 15

A developer was prepared in the same manner as in Example 30 except for replacing additive A-(2) with the same amount of titanium oxide (P25).

Copying tests were carried out using the developers prepared in Examples 30 to 34 and Comparative Example 15, respectively, on a copying machine A-COLOR 635, manufactured by Fuji Xerox Co., Ltd., to obtain 200,000 copies in a high temperature and high humidity environment (30° C., 90% RH) and a low temperature and low humidity environment (5° C., 10% RH). The results of the evaluation are shown in Tables 10 and 11 below. The solid density was measured with X-Rite 404A. The criteria of the evaluation of background stains (fog) and the method for obtaining toner concentration latitude (TCL) are the same as in Example 23.

TABLE 10

| | | Initial Stage of Copying Test | | | | | | | | | |
|---|---|---|---|---|---|---|---|---|---|---|---|
| | | Environment 1* | | | | | Environment ** | | | | |
| | | Image Characteristics | | | | | Image Characteristics | | | | |
| Example No. | Carrier | Charge Quantity (μC/g) | Solid Density | Back-ground Stains | TCL (%) | Image Defect | Charge Quantity (μC/g) | Solid Density | Back-ground Stains | TCL (%) | Image Defect |
| Example 30 | F | −15 | 1.51 | G2 | 2 | none | −18 | 1.50 | G1 | 5 | none |
| Example 31 | G | −17 | 1.45 | G1 | 8 | none | −20 | 1.45 | G1 | 7 | none |
| Example 32 | H | −18 | 1.41 | G1 | 6 | none | −22 | 1.35 | G1 | 7 | none |
| Example 33 | I | −22 | 1.35 | G1 | 4 | none | −25 | 1.25 | G1 | 3 | none |
| Example 34 | E | −18 | 1.38 | G1 | 6 | none | −20 | 1.36 | G1 | 5 | none |
| Compara. Example 15 | F | −5 | 1.21 | G3 | 0 | fog | −12 | 1.38 | G3 | 1 | fog |

Note:
*High temperature and high humidity environment
**Low temperature and low humidity environment

TABLE 11

| | | After Taking 200,000 Copies | | | | | | | | | |
|---|---|---|---|---|---|---|---|---|---|---|---|
| | | Environment 1* | | | | | Environment 2** | | | | |
| | | Image Characteristics | | | | | Image Characteristics | | | | |
| Example No. | Carrier | Charge Quantity (μC/g) | Solid Density | Back-ground Stains | TCL (%) | Image Defect | Charge Quantity (μC/g) | Solid Density | Back-ground Stains | TCL (%) | Image Defect |
| Example 30 | F | −13 | 1.40 | G2 | 1.5 | none | −15 | 1.45 | G2 | 2.0 | none |
| Example 31 | G | −16 | 1.45 | G1 | 6.5 | none | −20 | 1.50 | G1 | 6.5 | none |
| Example 32 | H | −18 | 1.42 | G1 | 5 | none | −20 | 1.48 | G1 | 5.5 | none |
| Example 33 | I | −25 | 1.25 | G1 | 3 | none | −30 | 1.20 | G1 | 2.0 | none |
| Example 34 | E | −8 | 1.25 | G2 | 1.5 | none | −12 | 1.35 | G2 | 1.5 | none |
| Compara. Example 15 | F | −2 | 0.30 | G5 | 0 | fog | −5 | 0.52 | G5 | 0 | fog |

Note:
*High temperature and high humidity environment
**Low temperature and low humidity environment The present invention is characterized by the use of the external additive obtained by coating titanium oxide particles with 0.1 to 2.0% by weight, in terms of $Al_2O_3$ , of aluminum or $Al_2O_3$ to form an aluminum or $Al_2O_3$ coating film and subjecting the coated particles to surface treatment with a treating agent, preferably one or more of an anionic surface active agent, an amphoteric surface active agent, a silane coupling agent and a silicone oil, with or without a fatty acid or a fatty acid ester. The toner of the invention exhibits fluidity, caking resistance and moderate negative chargeability, and maintains its charging properties in a stable manner for an extended period of time irrespective of the environmental conditions, whether in a high temperature and high humidity environment or a low temperature and low humidity environment. In particular, when the surface treatment of the coated titanium oxide particles is carried out in an aqueous solution or a solvent, the resulting surface treated titanium oxide fine particles are free from agglomeration and can therefore maximize their performance as an external additive. In this particular embodiment, ultrafine titanium oxide particles can be collected nearly in the form of primary particles, making it possible to provide a toner having excellent fluidity and caking resistance. The coating treatment and the subsequent surface treatment (double layer treatment) impart moderate negative chargeability to titanium oxide particles. When added to a toner, the thus treated titanium oxide fine particles provide charging performance that can last stably for a prolonged period of time under either a high temperature and high humidity condition or a low temperature and low humidity condition. Where a polyester resin or an epoxy resin is used as a toner binder resin, there has been a problem that the charging performance of the toner extremely varies with environmental changes between a high temperature and high humidity environment and a low temperature and low humidity environment. The present invention manifests great effects in solving this problem. The external additive according to the invention further brings about advantages that: chargeability increases the instant a supplementary toner is added; the additive does not seriously contaminate a sleeve, a blade or a carrier because it always functions while sticking to toner particles in development and transfer; and the additive does not cause filming nor scratches on a photoreceptor, thereby providing a stale image for a long period of time.

Where the treated titanium oxide-containing toner is combined with a carrier coated with a silicone-modified acrylic resin or a fluoroalkyl(meth)acrylate resin and having a volume resistivity of $10^6$ to $10^{12}$ Ω.cm, variations in charging properties due to adhesion of a toner component to the carrier or peeling-off of the resin coat of the carrier can be prevented. As a result, image quality can be maintained constant, background stains which occur on addition of a supplementary toner are suppressed, the developer life is extended, high image quality is stably assured, and images with excellent reproducibility in both black solid image areas and fine line image areas can be obtained.

When a charging member is coated with a resin mainly comprising a silicone-modified acrylic resin, the ability of maintaining the charging properties, the environmental stability and the ability of maintaining image quality of the charging member are improved greatly thereby to provide high quality images free from density unevenness or background stains.

While the invention has been described in detail and with reference to specific examples thereof, it will be apparent to one skilled in the art that various changes and modifications can be made therein without departing from the spirit and scope thereof.

What is claimed is:

1. A toner for developing an electrostatic latent image, which comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent, wherein said surface treatment is carried out using a treating agent selected from the group consisting of an anionic surface active agent, an amphoteric surface active agent, a silane coupling agent and a silicone oil in a solution.

2. The toner according to claim 1, wherein said toner contains said treated titanium oxide fine particles in an amount of from 0.1 to 5.0% by weight based on the weight of the toner.

3. The toner according to claim 1, wherein said treating agent is selected from an anionic surface active agent, an amphoteric surface active agent, a silane coupling agent and a silicone oil.

4. The toner according to claim 3, wherein the amount of said treating agent used in the surface treatment is from 5 to 50% by weight based on said treated titanium oxide fine particles.

5. The toner according to claim 1, wherein said coating comprises:

adding a compound selected from the group consisting of aluminum chloride, aluminum sulfate, aluminum nitrate, hydrated alumina, hydrated alumina-silica, hydrated alumina-titania, hydrated alumina-titania-silica and hydrated alumina-titania-silica-zinc oxide to an aqueous solution or solvent;

dipping titanium oxide fine particles in said solution or solvent; and drying said coated particles.

6. The toner according to claim 3, wherein said treating agent is a silane coupling agent, and said silane coupling agent is used in combination with a fatty acid or a fatty acid ester.

7. A developer for developing an electrostatic latent image, which comprises a resin-coated carrier and a toner, wherein said toner comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent, wherein said surface treatment is carried out using a treating agent selected from the group consisting of an anionic surface active agent, an amphoteric surface active agent, a silane coupling agent and a silicone oil in a solution.

8. The developer according to claim 7, wherein said toner contains said treated titanium oxide fine particles in an amount of from 0.1 to 5.0% by weight based on the weight of the toner.

9. The developer according to claim 7, wherein the coating resin of said resin-coated carrier comprises a silicone-modified acrylic resin, a fluoroalkyl acrylate resin or a fluoroalkyl methacrylate resin.

10. The developer according to claim 7, wherein said resin-coated carrier has a volume resistivity of $10^6$ to $10^{12}$ Ω.cm at application of $10^{3.8}$ V.

11. An image forming process comprising the steps of:

forming an electrostatic latent image on an electrostatic latent image holder;

developing the electrostatic latent image on the electrostatic latent image holder with a developer held on a developer carrying member disposed so as to face the electrostatic latent image holder, to thereby form a toner image; and transferring the thus formed toner image to an image-receiving sheet, wherein said developer comprises toner particles and treated titanium oxide fine particles obtained by coating titanium oxide fine particles with 0.1 to 2.0% by weight, in terms of $Al_2O_3$, of aluminum or $Al_2O_3$ and further subjecting the coated particles to surface treatment with a treating agent, wherein said surface treatment is carried out using a treating agent selected from the group consisting of an anionic surface active agent, an amphoteric surface active agent, a silane coupling agent and a silicone oil in a solution.

12. The image forming process according to claim 11, wherein said toner contains said treated titanium oxide fine particles in an amount of from 0.1 to 5.0% by weight based on the weight of the toner.

13. The image forming process according to claim 11, further comprising charging said developer by a charging member, wherein said charging member comprises a silicone-modified acrylic resin, a fluoroalkyl acrylate resin or a fluoroalkyl methacrylate resin.

14. The image forming process according to claim 13, wherein said toner contains said treated titanium oxide fine particles in an amount of from 0.1 to 5.0% by weight based on the weight of the toner.

* * * * *